US006995502B2

(12) United States Patent
Hwu et al.

(10) Patent No.: US 6,995,502 B2
(45) Date of Patent: Feb. 7, 2006

(54) SOLID STATE VACUUM DEVICES AND METHOD FOR MAKING THE SAME

(75) Inventors: Ruey-Jen Hwu, Salt Lake City, UT (US); Larry Sadwick, Salt Lake City, UT (US)

(73) Assignee: Innosys, Inc., Salt Lake City, UT (US)

( * ) Notice: Subject to any disclaimer, the term of this patent is extended or adjusted under 35 U.S.C. 154(b) by 0 days.

(21) Appl. No.: 10/067,616

(22) Filed: Feb. 4, 2002

(65) Prior Publication Data

US 2003/0146689 A1 Aug. 7, 2003

(51) Int. Cl.
*H01J 1/46* (2006.01)

(52) U.S. Cl. ..... 313/293; 313/495

(58) Field of Classification Search ..... 313/495, 313/309, 308, 310, 336, 496, 497, 351, 293
See application file for complete search history.

(56) References Cited

U.S. PATENT DOCUMENTS 3,701,919 A 10/1972 Geppert
3,789,471 A 2/1974 Spindt et al.
3,855,499 A 12/1974 Yamada et al.
3,921,022 A 11/1975 Levine
3,970,887 A 7/1976 Smith et al.
3,978,364 A 8/1976 Dimeff et al.
4,019,081 A 4/1977 Buxbaum et al.
4,138,622 A 2/1979 McCormick et al.
4,712,039 A 12/1987 Hong
4,721,885 A 1/1988 Brodie
4,855,636 A 8/1989 Busta et al.
4,897,574 A * 1/1990 Saito et al. ..... 313/346 R
4,924,137 A 5/1990 Watanabe et al.
4,983,878 A 1/1991 Lee et al.
4,987,377 A 1/1991 Gray et al.
5,038,070 A 8/1991 Bardai et al.
5,053,673 A 10/1991 Tomii et al.
5,141,459 A * 8/1992 Zimmerman ..... 445/24
5,181,874 A 1/1993 Sokolich et al.
5,199,918 A 4/1993 Kumar
5,223,766 A * 6/1993 Nakayama et al. ..... 313/495
5,285,131 A * 2/1994 Muller et al. ..... 313/578
5,334,908 A * 8/1994 Zimmerman ..... 313/336
5,397,957 A * 3/1995 Zimmerman ..... 313/309
5,411,426 A 5/1995 Boysel
5,463,277 A 10/1995 Kimura et al.
5,475,281 A 12/1995 Heijboer
5,493,177 A * 2/1996 Muller et al. ..... 313/578
5,502,314 A 3/1996 Hori (Continued)

*Primary Examiner*—Joseph Williams
*Assistant Examiner*—Dalei Dong
(74) *Attorney, Agent, or Firm*—Morriss O'Bryant Compagni, P.C.

(57) ABSTRACT

A solid-state vacuum device (SSVD) and method for making the same. In one embodiment, the SSVD forms a triode device comprising a substrate having a cavity formed therein. The SSVD further comprises cathode positioned near the opening of the cavity, wherein the cathode spans over the cavity in the form of a bridge that creates an air gap between the cathode and substrate. In addition, the SSVD further comprises an anode and a grid that is positioned between the anode and cathode. Upon applying heat to the cathode, electrons are released from the cathode, passed through the grid, and received by the anode. In response to receiving the electrons, the anode produces a current. The current received by the anode is controlled by a voltage applied to the grid. Other embodiments of the present invention provide diode, tetrode, pentode, and other higher order device configurations.

39 Claims, 12 Drawing Sheets

U.S. PATENT DOCUMENTS 5,561,345 A * 10/1996 Kuo ..... 313/495
5,614,781 A * 3/1997 Spindt et al. ..... 313/422
5,729,086 A * 3/1998 Jeong et al. ..... 313/495
5,841,219 A * 11/1998 Sadwick et al. ..... 313/293
5,847,496 A * 12/1998 Nakamoto et al. ..... 313/495
5,850,120 A * 12/1998 Okamoto ..... 313/336
5,892,323 A * 4/1999 Zimmerman ..... 313/309
5,955,828 A * 9/1999 Sadwick et al. ..... 313/310
5,973,444 A * 10/1999 Xu et al. ..... 313/495
6,008,576 A * 12/1999 Nakatani et al. ..... 313/495
6,051,923 A * 4/2000 Pong ..... 313/306
6,057,636 A * 5/2000 Sakai et al. ..... 313/346 R
6,091,189 A * 7/2000 Shinjo et al. ..... 313/497
6,121,725 A * 9/2000 Grand-Clement et al. .. 313/495
6,124,671 A * 9/2000 Fushimi et al. ..... 313/309
6,157,123 A * 12/2000 Schmid et al. ..... 313/422
6,184,610 B1 * 2/2001 Shibata et al. ..... 313/309
6,291,288 B1 9/2001 Huang et al.
6,633,119 B1 * 10/2003 Chalamala et al. ..... 313/495

* cited by examiner

SOLID STATE VACUUM DEVICES AND METHOD FOR MAKING THE SAME

FIELD OF THE INVENTION

The present invention relates to semiconductor devices and vacuum devices, and in particular, to devices configured to operate in a vacuum environment and devices manufactured through microelectronic, micro electro-mechanical systems (MEMS), micro system technology (MST), micromachining, and semiconductor manufacturing processes.

BACKGROUND OF THE INVENTION

Vacuum tubes were developed at or around the turn of the century and immediately became widely used for electrical amplification, rectification, oscillation, modulation, and wave shaping in radio, television, radar, and in all types of electrical circuits. With the advent of the transistor in the 1940s and 1950s and integrated circuit technology in the 1960s, the use of the vacuum tube began to decline, as circuits previously employing vacuum tubes were adapted to utilize solid-state transistors. The result is that today more circuits are utilizing solid-state semiconductor devices, with vacuum tubes remaining in use only in limited circumstances such as those involving high power, high frequency, or hazardous environmental applications. In these limited circumstances, solid-state semiconductor devices generally cannot accommodate the high power, high frequency or severe environmental conditions.

There have been a number of attempts at fabricating vacuum tube devices using solid-state semiconductor device fabrication techniques. One such attempt resulted in a thermionic integrated circuit formed on the top side of a substrate, with cathode elements and corresponding grid elements being formed co-planarly on the substrate. The anodes for the respective cathode/grid pairs were fabricated on a separate substrate, which was aligned with the first-mentioned substrate such that the cathode to anode spacing was on the order of one millimeter. With this structure, all the cathode elements were collectively heated via a macroscopic filament heater deposited on the backside of the substrate. Accordingly, this structure required a relatively high temperature operation and the need of substrate materials having high electrical resistivity at elevated temperatures. Among the problems with this structure were inter-electrode electron leakage, electron leakage between adjacent devices, and functional cathode life.

SUMMARY OF THE INVENTION

The present invention provides a solid-state vacuum device (SSVD) that operates in a manner similar to that of a traditional vacuum tube. Generally described, one embodiment of an SSVD comprises a cathode, anode, and a grid. In alternative embodiments, the SSVD also comprises a plurality of grid layers, also referred to as a plurality of electrodes, for forming other higher order SSVD's. In several embodiments, the cathode is heated by a structure via a circuit that causes the cathode to emit electrons; this configuration is referred to as an indirectly heated cathode. In another configuration, which is referred to as a directly heated cathode, the heater circuit provides energy/power to a structure that is directly part of and in electrical contact with the cathode and it emits electrons when it is heated. Other possible electron emission mechanisms include photo-induced emission, electron injection, negative affinity, and any other mechanisms known in the art. As can be appreciated by one of ordinary skill in the art, these electron emission mechanisms can be also used separately or in conjunction with the thermionic emission. The electrons are passed through the grid and received by the anode. In response to receiving the electrons from the cathode, the anode produces a current that is fed into an external circuit. The magnitude of the flow of electrons through the grid is regulated by a control circuit that supplies a voltage to the grid. Accordingly, the voltage applied to the grid controls the electrical current received by the anode.

In one embodiment, the present invention provides an SSVD in a triode configuration. In this embodiment, the SSVD comprises a substrate having a cavity formed into the substrate. The SSVD further comprises a cathode positioned near the opening of the cavity formed in the substrate, an anode suspended over the cathode and a grid positioned between the cathode and anode. The grid comprises at least one aperture for directing the passage of electrons traveling from the cathode to the anode. The grid is made from a conductive material. In addition, the SSVD comprises an enclosed housing for creating a controlled environment in an area surrounding the grid, cathode, and anode. In one embodiment, the controlled environment is a vacuum environment, which allows for electron flow between the cathode, grid and anode.

In one embodiment, the cathode is in the form of a suspended bridge, referred to as an "air bridge," which functions as a thermal barrier between the cathode and substrate. The air bridge is suspended over a cavity formed in a substrate, leaving an open area between the cathode and the substrate. In one embodiment, the air bridge, having a substantially rectangular shape, is supported at opposite ends. In another embodiment, the air bridge is supported at one end, thereby forming an air bridge structure having at least three suspended sides. In one embodiment, the air bridge creates an air gap of about 5 to 10 microns between the cathode and the substrate. By the use of the fabrication processes described below, a diode, triode or other higher order device configurations having a suspended air bridge structure can be manufactured.

In one specific embodiment, the present invention provides an SSVD in a diode configuration. In this embodiment, the SSVD comprises a substrate having a cavity formed into the substrate. The SSVD further comprises a cathode in the form of an air bridge suspended over the cavity of the substrate. This embodiment further comprises an anode suspended over the cavity where the anode is positioned and configured to receive electrons from the cathode. This embodiment of the SSVD also comprises an enclosed housing for creating a controlled environment surrounding the cathode and anode.

In other embodiments, the present invention provides a number of higher order devices such as a tetrode and pentode. In these embodiments, the SSVD comprises a substrate having a cavity formed in the substrate. These embodiments further comprise a cathode in the form of an air bridge, an anode positioned over the cathode, and a plurality of grid layers positioned between the cathode and anode. More specifically, the tetrode configuration comprises two grid layers, and the pentode configuration comprises three grid layers. In the tetrode configuration, the SSVD comprises two aligned grid layers to provide an increased power generation capacity that is characteristic of a pentode. The grid layers of these alternative embodiments comprise at least one aperture for directing the passage of electrons from the cathode to the anode. By the use of novel fabrication methods of the present invention, other higher order devices may be constructed by providing additional grid layers to the SSVD structures described herein.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

The present invention provides a sub micron-scale to cm-scale and beyond, solid-state vacuum device that operates in a manner similar to that of a traditional vacuum tube devices. As described below, the present invention includes a plurality of embodiments where a device is configured to form a diode, triode, tetrode, pentode or other higher order devices made from novel semiconductor fabrication techniques. The following sections provide a detailed description of each embodiment and several fabrication methods for making the devices disclosed herein. Supplemental information is also provided in a contemporaneously filed patent application entitled "Solid State Vacuum Devices and Method for Making the Same," which is commonly assigned to InnoSys, Inc. of Salt Lake City, Utah, and naming Ruey-Jen Hwu and Larry Sadwick as co-inventors; the subject matter of which is incorporated by reference.

Figure 1:
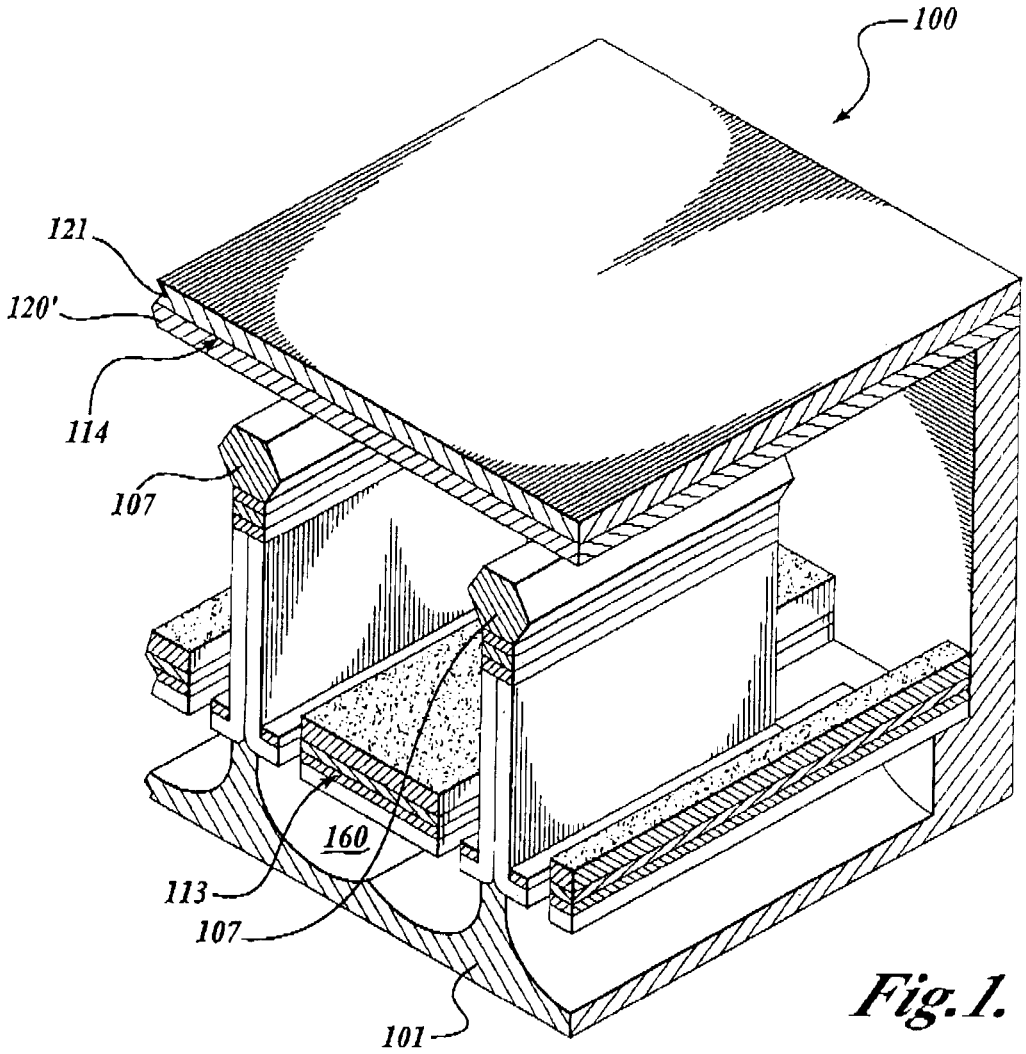
FIG. 1 is a top front cross-sectional perspective view of one embodiment of a device in accordance with the present invention.

Referring now to FIG. 1, the basic elements of one embodiment of a triode solid state vacuum device 100 (hereinafter referred to as the triode 100) are shown. Generally described, the triode 100 comprises a substrate 101 having a cavity 160 formed in the substrate 101. The triode 100 further comprises a cathode 113 positioned near the opening of the cavity 160. As described in detail below, the cathode 113 is in the form of an air bridge structure that spans over the opening of the cavity 160. The triode 100 further comprises an anode 114 that is vertically positioned above the cathode 113, and a grid 107 positioned between the cathode 113 and anode 114. Also shown in FIG. 1, the triode 100 comprises an enclosed housing for creating a controlled environment in an area surrounding the cathode 113, anode 114 and grid 107. A controlled environment, such as a vacuum environment, allows charged carriers to move between the cathode 113, anode structure 114 and grid 107.

In the operation of the triode 100, the cathode 113 is heated by a circuit that causes the cathode 113 to emit charged carriers, such as electrons. The emitted electrons pass through apertures in the grid 107 and received by the anode 114. In response to receiving the electrons from the cathode 113, the anode 114 produces a current. The magnitude of the flow of electrons through the grid 107 is controlled by a circuit that supplies a voltage to the grid 107. Accordingly, the voltage applied to the grid 107 controls the electrical current received by the anode 114.

Figure 2:
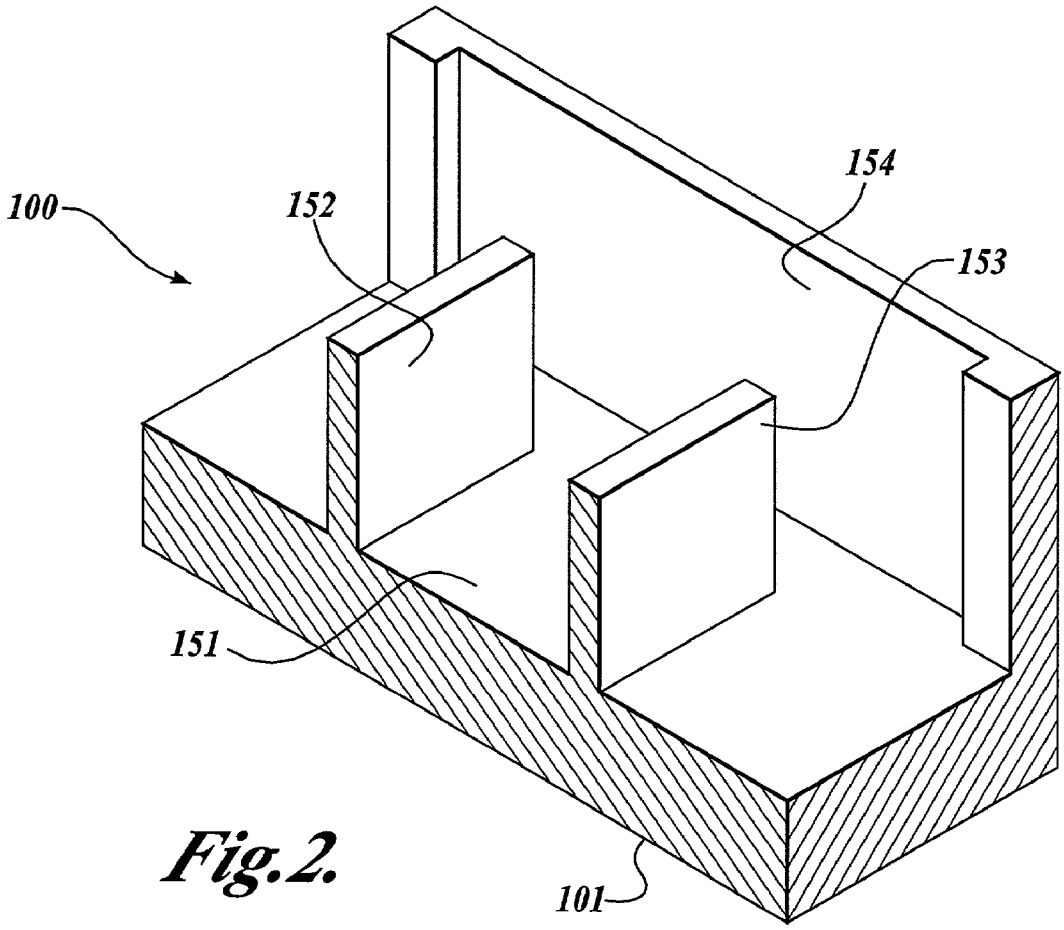
FIG. 2 is a top front cross-sectional perspective view of a formed substrate utilized in one embodiment of the device shown in FIG. 1.
Figure 3A:
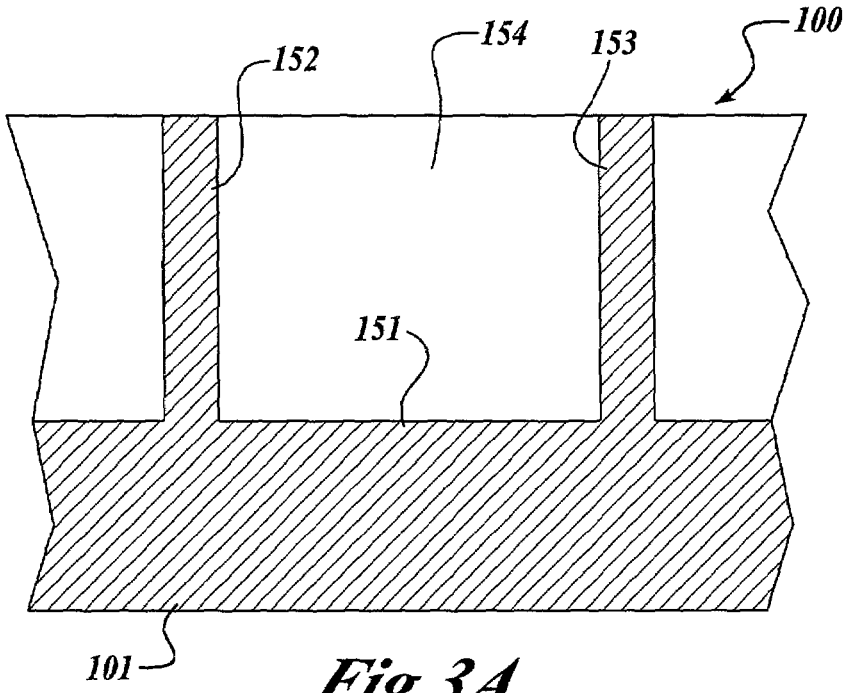
FIGS. 3A–3D illustrate several steps employed in one embodiment of a fabrication process for forming the device depicted in FIG. 1.
Figure 3B:
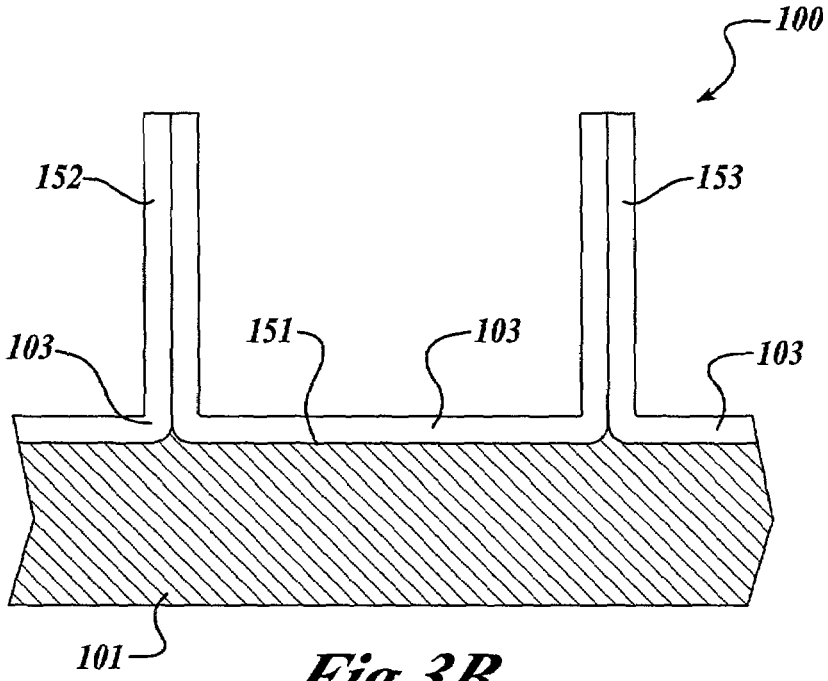
Figure 3C:
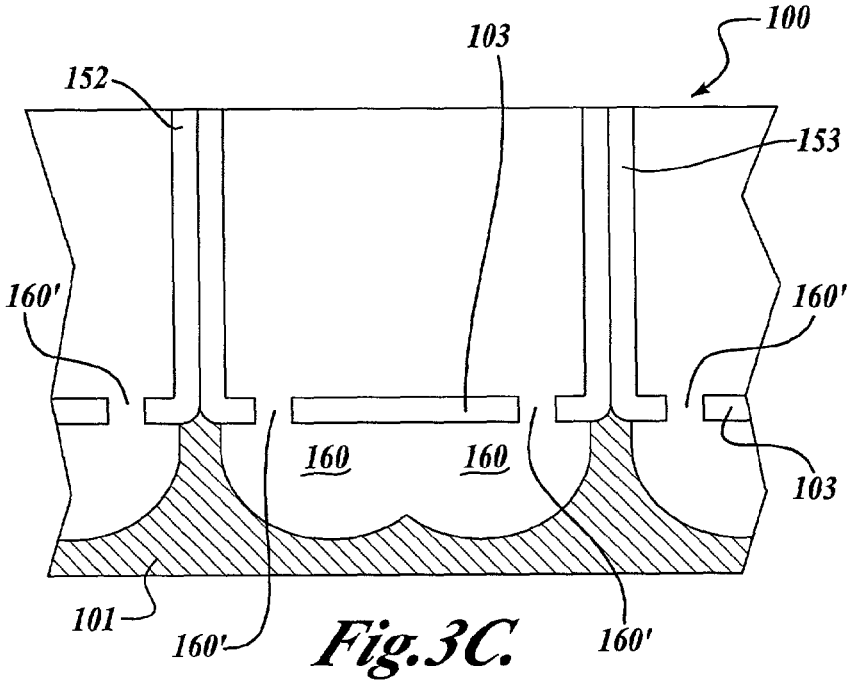
Figure 3D:
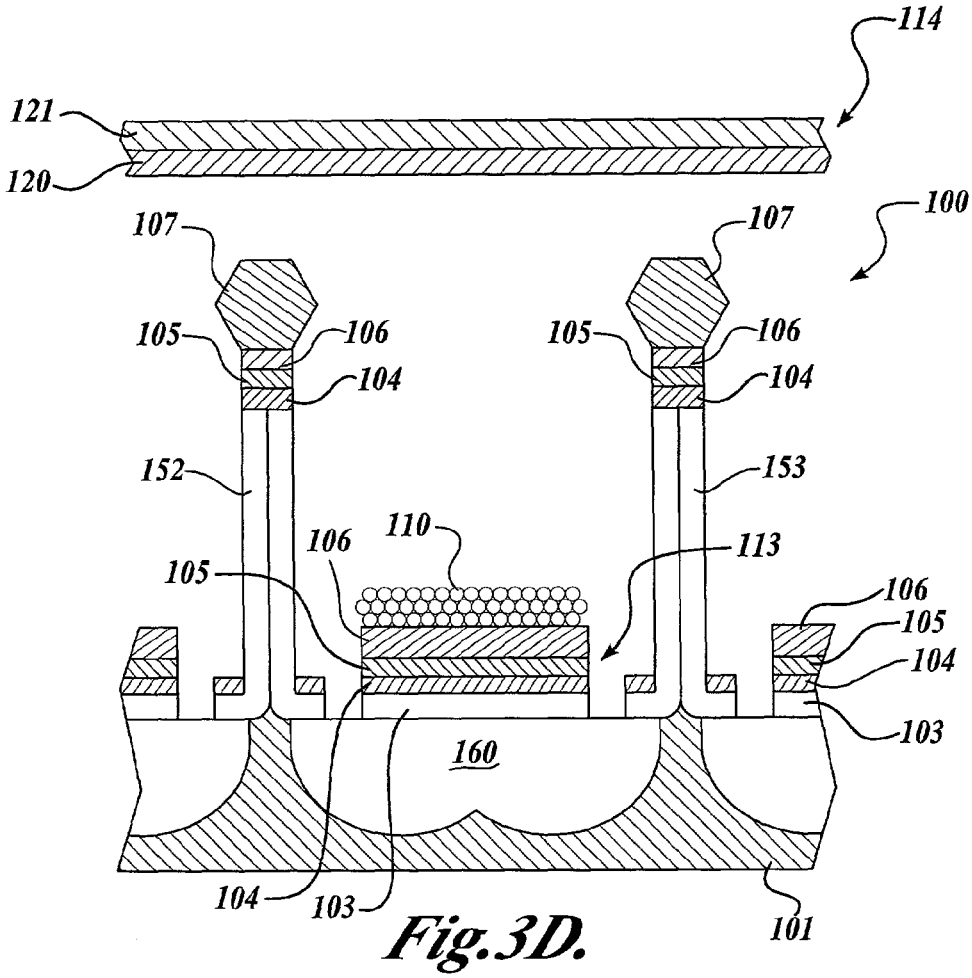

Referring now to FIGS. 2–3D, one embodiment of a fabrication process forming the triode 100 (FIG. 1) is shown and described below. FIG. 2 is a top, front perspective view of one embodiment of a formed substrate 101 utilized in the construction of the triode 100. The formed substrate 101 comprises a first support 152, second support 153, supporting wall 154 and a base 151. In one illustrative embodiment, the first and second supports 152 and 153 are each formed into a generally elongated ridge-shaped structure having a top surface sized to support device components disposed thereon. In this embodiment, the ridge formed by the first support 152 is substantially parallel to the ridge formed by the second support 153. In addition, each support 152 and 153 may be similar or, in many embodiments, identical in size and dimension. Also shown in the front sectional view of FIG. 3A, the cross-section of each support 152 and 153 may be in a rectangular shape that extends in a vertical direction away from the top surface of the substrate 101. Although the illustrative embodiment shown in FIG. 2 comprises only two supports 152 and 153, other embodiments having more than two supports, such as an array of supports, are within the scope of the present invention. In addition, although the example of FIG. 2 illustrates one embodiment having the supports 152 and 153 on the top side of the substrate 101, the supports 152 and 153, and the other components of the triode 100, may be oriented on any one side or multiple sides of the substrate 101. As shown in FIGS. 2 and 3A, the base 151 forms a substantially flat surface on the top of the substrate 101 between the first support 152 and second support 153. The base 151 is preferably formed into a flat surface that defines a plane that is substantially perpendicular to the planes defined by the supports 152 and 153. In addition, the plane defined by the top surface of the base 151 is substantially perpendicular to a plane defined by the vertical surface of the supporting wall 154. Although this illustrative embodiment shows first and second supports 152 and 153 having a substantially rectangular cross-section, supports having any other shape, including circles or triangles, capable of supporting raised conductive layers are well within the scope of the present invention.

The supporting wall 154 functions as a barrier to create a closed environment surrounding the device components that are positioned near first and second supports 152 and 153. As shown in FIG. 1, a closed environment is formed when the anode 114, also referred to as an anode structure, is affixed on the supporting wall 154. Accordingly, as suggested by the cut-away section, the supporting wall 154 may be configured to surround the entire perimeter of the top surface of the base 151 to provide the enclosed environment around the device components positioned near the first and second supports 152 and 153. In one embodiment, the supporting wall 154 is formed into a substantially flat, vertically aligned surface that is formed as part of the base substrate 101. In another embodiment, the supporting wall 154 is formed from a separate substrate component that is affixed on the top surface of the base 151. The supporting wall 154 can be made from any material and formed into any shape that sufficiently creates a controlled environment around the device components. In addition, it is preferred that the supporting wall 154 is formed into a structure that sufficiently holds the anode structure 114 in position.

The first support 152, second support 153, and the supporting wall 154 may be formed by any known fabrication method. In one embodiment, the formed substrate 101 may be shaped by a dry etching process. In other examples, the substrate 101 may be shaped by glow-discharge, sputtering, chemical basis etching, or a combination of glow-discharge, sputtering or chemical based etching. In another embodiment, additive processes can be used to shape the substrate 101.

The substrate 101, also referred to as the base substrate, can be made from any material such as a polycrystalline material, an amorphous material, a variety of silicon type materials or other suitable substrate material having the ability for appropriate properties including, in many cases, insulating properties. For example, the substrate 101 may be made of glass, sapphire, quartz, plastic, oxidized polycrystalline silicon, oxidized amorphous silicon, silicon, silicon dioxide, silicon nitride, magnesium oxide, gallium arsenide semiconductor substrates or any other material having like properties. Alternatively, the substrate 101 may comprise a conductive material and insulating layer disposed on the conductive material.

As shown in FIGS. 3B–3D, the formation of specific components of the triode 100 are shown and described below. The scale of the device components illustrated in these figures are enlarged to better illustrate the fabrication process of the present invention. It is to be appreciated by one of ordinary skill in the art that each component described below and illustrated in these figures may be made in any scale without departing from the scope of the present invention.

Referring now to FIG. 3B, one embodiment of the triode 100 comprises an oxidation layer 103 disposed on the substrate 101. In one embodiment, the oxidation layer 103 is a silicon dioxide ($SiO_2$) layer disposed on the substrate 101. The oxidation layer 103 may be applied to the substrate 101 by the use of any generally known fabrication method such as wet or dry oxidation, sputtering evaporation, or any other like method. As shown in FIG. 3B, the oxidation layer 103 is deposited on the substrate 101 in a substantially uniform layer over the surface of the formed substrate 101. More specifically, in one embodiment, the oxidation layer 103 may be uniformly applied over the vertically aligned surfaces of the first and second supports 152 and 153. In addition, the oxidation layer 103 is also uniformly applied to the top surface of the base 151 of the substrate 101. In one embodiment, the oxidation layer 103 may be applied on the substrate 101 having a thickness between 1000 Angstroms to 1 cm. Although this illustrative embodiment comprises an oxidation layer 103 having a thickness in a specific range, any thickness and/or dimension of the oxidation layer may be used without departing from the scope of the present invention.

As shown in FIG. 3C, the triode 100 further comprises a cavity 160 formed underneath the oxidation layer 103. In one embodiment, the cavity 160 is formed by first etching a plurality of slotted cavities 160' in the oxidation layer. As shown in FIG. 3C, the slotted cavities 160' are positioned near the base of each support grid 152 and 153 and each slotted cavity 160' is formed into an elongated groove that extends along the side of each support 152 and 153. Referring to FIG. 4B, a top view of one embodiment of the slotted cavities 160' is shown, where each slotted cavity 160' is shaped into an elongated groove that is positioned along the side of each support 152 and 153. Also shown in FIG. 4B, the slotted cavities 160' isolate a rectangular section of the oxidation layer 103 between the first and second grid supports 152 and 153. As will be described in more detail below, the isolated section of the oxidation layer 103 creates a surface for the mounting of the cathode 113 components.

Referring again to FIG. 3C, once the slotted cavities 160' are formed, a cavity 160 is formed underneath the isolated section of the oxidation layer 103. As shown, the cavity 160 is configured to form an air gap under the isolated section of the oxide layer 103, thereby creating an air bridge structure for suspending the cathode 113. As described above, the air gap created by the cavity 160 provides thermal insulation between the cathode 113 and substrate 101.

The slotted cavities 160' in the oxidation layer 103 can be formed by any generally known fabrication process for creating shaped cavities in an unoxidized material or an oxidation material. The cavity 160 can be formed by any generally known fabrication process that is suitable for removing large volumes of substrate material underneath a thin surface layer, such as oxidation layer 103. In one embodiment, the cavity 160 may be formed by a bulk micromachining technique. For example, if the substrate 101 is made from a single-crystal silicon, the bulk micromachining is achieved by anisotropic, isotropic wet etching or plasma dry etching techniques.

In the method involving anisotropic wet etching, generally accepted etching solutions for silicon may be used. For example, potassium hydroxide (KOH), hydrazine ($N_2H_2$), and ethylene diamine pyrocatechol/water (EDP)/$H_2O$ may be utilized in this embodiment. As can be appreciated by one of ordinary skill in the art, the etching rate of certain solutions is more effective in a vertical direction compared to the etching rate in a horizontal direction. Also known in the art, the selectivity of a solution is defined as the ratio of the etch rate in a desired direction in relation to the etch rate in an undesired direction. In one embodiment of the fabrication process, a weight percentage of KOH of 22.5% in a water solution at 80° C. may yield a selectivity of 108. A solution having this selectivity may be used to form the cavity 160 as shown in FIG. 3C. To further control the shape of the cavity 160, areas of a silicon substrate material may be doped with boron to reduce the etching rate in specific regions. For example, the substrate material under the supports 152 and 153 may be doped with boron to provide additional support in those areas of the substrate 101 during the etching process.

In another embodiment, a dry etching fabrication process may be utilized to create the cavity 160. As can be appreciated by one of ordinary skill in the art, there are many types of dry etching including sputtering etching, wet chemical etching, and dry plasma etching. A combination of these methods may also be employed and utilized.

Referring now to FIG. 3D, the fabrication process for forming the cathode 113 and grid 107 is shown and described. As shown in FIG. 3D, after the cavity 160 is created in the substrate 101, the fabrication process involves the application of a first conductive layer 104. In this part of the process, the first conductive layer 104 is applied directly onto the horizontal surfaces of the oxidation layer 103. As shown in FIG. 3D, one embodiment of the triode 100 involves the application of the first conductive layer 104 on the top surface of the isolated section of the oxidation layer 103 and on the top surfaces of each support 152 and 153. As described above, the top surface of each support 152 and 153 forms a substantially flat surface for supporting the application of additional device components. Accordingly, the first conductive layer 104 may be uniformly applied to the top of each support 152 and 153 in a process that is similar to the application of the oxidation layer 103.

In one embodiment, the first conductive layer 104 may be made from a high temperature, electrically conductive material such as tungsten, nickel, molybdenum, platinum, tantalum, titanium, semimetal, semiconductors, silicides, polysilicon, alloys, intermetallics, or any other like material. As known to one of ordinary skill in the art, the first conductive layer 104 may be deposited on the oxide layer 103 by the use of any fabrication process such as physical vapor deposition (PVD) metal sputtering, chemical vapor deposition (CVD) or a process employing beam evaporation. In one embodiment, the first conductive layer 104 may be configured to have a thickness of 100 Angstroms or less. In other embodiments, the first conductive layer 104 may have a thickness in a range of one micron to one millimeter. Although these dimensions are used in this illustrative embodiment, the first conductive layer 104 may be configured to any thickness to accommodate any desired design specification.

Once the first conductive layer 104 is deposited onto the oxidation layer 103, the fabrication process involves the application of an insulating layer 105. As illustrated in FIG. 3D, the insulating layer 105 is deposited directly onto the horizontal surfaces of the first conductive layer 104. More specifically, the insulating layer 105 is disposed on the surface between the first and second supports 152 and 153, and also, the insulating layer 105 may be optionally disposed on the supports 152 and 153. In addition, the insulating layer 105 is disposed on the top surfaces of each support 152 and 153. In one embodiment, the insulating layer 105 is deposited directly onto the first conductive layer 104.

The insulating layer 105 can be made from any material having electrically resistive properties. For example, the insulating layer 105 may be made from ceramic, silicon dioxide, or the like. As can be appreciated by one of ordinary skill in the art, the insulating layer 105 may be deposited onto the conductive layer 104 by the use of any known fabrication method such as oxidation, sputtering, evaporation, or any other like method.

The first conductive layer 104 functions as an electrical heater to heat an electron-emitting material 110 deposited on the air bridge structure. In one embodiment, the first conductive material 104 may be made of a low resistance metal that rises to high temperatures when a voltage source is applied thereto. Several examples of a low resistance metal providing a thermal source include metals such as tungsten, molybdenum, tantalum, platinum, alloys, intermetallics, or the like. Although these low resistance metals are used in this illustrative example, any other appropriate resistance metals for creating a heat source may be used in the construction of any one of the devices disclosed herein. The insulating layer 105 may be applied by a number of known fabrication methods, such as sputtering. In one embodiment, the insulating layer 105 has a thickness in the range of much less than one micron to one millimeter. Although this range is used in this illustrative embodiment, the insulating layer 105 may be formed to any other desired thickness greater or less than this range. Referring again to FIG. 3D, the fabrication process of the triode 100 further comprises the application of a second conducting layer 106. In one embodiment, the second conducting layer 106 is deposited directly onto the surface of the insulating layer 105. As can be appreciated by one of ordinary skill in the art, any form or thickness of the second conducting layer 106 conforms to the scope of the present invention.

Also shown in FIG. 3D, the fabrication process of the cathode 113 further comprises the application of an electron-emitting material 110. As shown in FIG. 3D, the electron-emitting material 110 is selectively disposed onto the surface of the second conducting layer 106 thereby forming the entire cathode structure 113. The electron-emitting material 110 may be made of any material with a suitably low work function for producing emissions of charged carriers, e.g., electrons. In one embodiment, the electron-emitting material 110 may be a carbonate of several elements, such as barium, strontium, and calcium. Although these materials are used in this illustrative example, any material with a suitably low work function may be used in the construction as the emitting material of the triode 100. The electron-emitting material 110 may be formed and selectively removed from the device by the use of conventional semiconductor, micromachining, microelectromechanical systems (MEMS), or micro system technology (MST) processing techniques, including such techniques as patterning, etching, and lift-off. Alternatively, the electron-emitting material 110 may be sprayed onto the conducting layer 106. In one embodiment, the electron-emitting material 110 is a mixture of barium carbonate, strontium carbonate and calcium carbonate in 45:51:4 percent by weight ratio.

Although the cathode 113 shown in FIG. 3D is disclosed as one illustrative embodiment of the present invention, the cathode 113 may comprise a variety of layers or combination of layers to form the air bridge structure of the cathode 113. For instance, it may be possible to utilize the electron-emitting material 110, also referred to as the low work function material, without the second conducting layer 106. This embodiment may be used depending on the nature and application of the low work function material.

In another alternative embodiment, the cathode 113 may be configured with two conductive layers interlaced with two insulating layers. In this alternative embodiment, the thermal heat source indirectly applies heat to the electron-emitting material of the cathode via an insulating layer. The cathode 113 first comprises a first insulating layer that forms the bottom of the air bridge structure. The first insulating layer may be formed in a shape and thickness similar to the configuration of the oxidation layer 103 shown in FIG. 3D. Next, a first conductive layer is disposed directly onto the first insulating layer. The first conductive layer of this embodiment is made of any material that functions as a thermal source, such as the above-described second conductive layer (105 of FIG. 3D). Next, a second insulating layer is disposed directly onto the first conductive layer. Preferably the insulating layer has a good thermal conductivity to transfer heat to the cathode base layer, second conducting layer. In this embodiment, the second insulating layer may be made of any material having electrically resistive properties such as aluminum oxide, silicon nitride, silicon dioxide or any other like material. Disposed directly onto the second insulating layer is a second conductive layer. The second conductive layer is preferably made from a conductive material such as nickel or tungsten. The second conductive layer can be formed into one continuous layer covering the second insulating layer, thereby providing a foundation for the application of the electron-emitting material. Accordingly, the electron-emitting material is disposed on the second insulating layer by the use of any process or processes including one of the above-described fabrication processes.

In another embodiment involving an indirect method of heating the electron-emitting material, the cathode structure 113 comprises a single insulating layer sandwiched between two conductive layers. In this embodiment, the first conductive layer is formed as the bottom of the air bridge structure. Hence, the first conductive layer may be formed in a shape and thickness similar to the configuration of the oxidation layer 103 shown in FIG. 3D. In this embodiment, the first conductive layer functions as the thermal source for the cathode 113. Thus, the first conductive layer may be made from any material that acts as a thermal source when a voltage is applied thereto. Next, an insulating layer is disposed directly onto the first conductive layer. The insulating layer of this embodiment electrically isolates the first conductive layer from other components of the cathode, and is preferably made from the material with suitable heat transfer properties. Disposed directly onto the insulating layer of this embodiment is a second conductive layer. The second conductive layer of this embodiment may be made from any electrically conductive material such as tungsten or nickel, appropriate constitutes added to nickel, and other suitable base metals. Next, the electron-emitting material is disposed directly onto the second conductive layer by, for example, the use of any one of the above-described fabrication processes.

Alternatively, the cathode 113 may comprise several embodiments where a conductive layer directly applies heat to the electron-emitting material. For instance, in one embodiment, the cathode 113 is constructed from a single layer of conductive material, which forms the entire air bridge structure. Similar to the second conductive layer 106 described above with reference to FIG. 3D, the single conductive layer of this embodiment is made from any material that functions as a thermal source and a base cathode layer when a voltage and current is applied thereto. To complete this embodiment of the cathode, a layer of electron-emitting material is disposed directly onto the single conductive layer.

In another embodiment employing a direct method of heating the electron-emitting material, the air bridge structure of the cathode 113 may be made of a single insulating layer and a signal conductive layer. In this embodiment, the insulating layer is configured to form the bottom of the air bridge structure. The single insulating layer of this embodiment is formed in a shape and configuration similar to the oxidation layer 103 shown in FIG. 3D. Next, a single conductive layer is disposed on the single insulating layer. In this embodiment, the single conductive layer functions as a thermal source for the cathode. Next, the electron-emitting material is disposed directly onto the conductive layer of this embodiment.

Referring again to FIG. 3D, the triode 100 further comprises a grid 107, also referred to as an electrode, that is formed on the top of each support 152 and 153. In one embodiment, the grid 107 is shaped into a number of elongated conductive strips that are selectively disposed, for example, onto the insulating layer 106 or conducting layer 105 positioned on the top of each support 152 and 153. With reference to FIGS. 1 and 3D, one embodiment of the grid 107 is configured to have a hexagonal section. Although this illustrative embodiment discloses a grid 107 having a generally hexagonal or rounded shape, the grid 107 may be formed in any shape that allows the grid 107 to influence the flow of electrons between the cathode and anode. For example, the grid 107 may include any general shape such as a parallel pipehead, spherical, cylindrical, or any appropriate geometrical shape. In one embodiment, as illustrated by the embodiment shown in FIGS. 1 and 3D, the grid 107 is formed to extend over the top edge of each support 152 and 153. In one embodiment, the grid 107 is constructed from an electrically conductive material. For instance, in several examples, the grid 107 may be made of tungsten, gold, tantalum, platinum, nickel, or any other material or combination thereof.

The grid 107 may be formed by the use of any known fabrication process for making or shaping formed, metallic layers. In one embodiment, the grid 107 is formed by the use of a sputtering, evaporation, or CVD technique combined with a photo-resistive material shaped by a mask. As can be appreciated by one of ordinary skill in the art, the fabrication process of the grid 107 may comprise a plurality of fabrication steps utilizing several masks to achieve the rounded shape of the grid 107. In other embodiments, the grid 107 may be formed by an electroplating process.

Also shown in FIG. 3D, the structure of one embodiment of the anode structure 114 is shown and described below. In this illustrative embodiment, the anode structure 114 comprises a substrate 121, and a conductive layer 120. More specifically, the anode structure 114 may be constructed from a substrate 121 having a conductive layer 120 disposed directly onto the substrate 121. The conductive layer 120, which functions to receive the electrons emitted from the cathode, may be made of any suitable conductive material such as tantalum, gold, tungsten, molybdenum, copper, or any other like material. In addition, in some embodiments, the conductive layer 120 may be made from carbon-containing materials, silicides, or other appropriate materials. The substrate 121 may be made from any material having a suitable strength for holding the conductive layer 120 in a fixed position over the grid 107 and cathode 113. For example, the second substrate 121 may be made from any one of the substrate materials described above with reference to the base substrate 101, including silicon, glass, ceramic, etc.

Figure 4A:
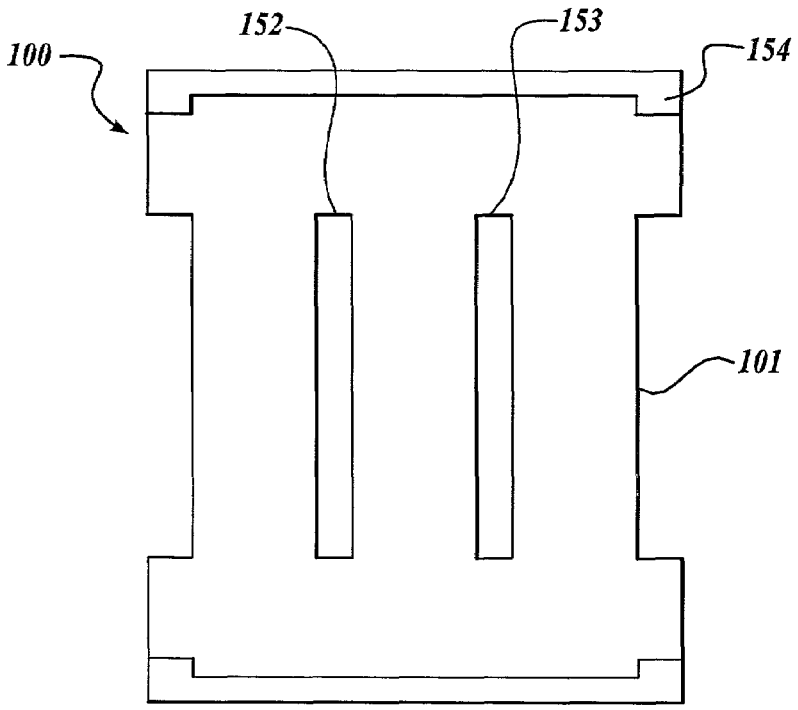
FIG. 4A is a top view of an etched substrate utilized in the construction of the device shown in FIG. 1.
Figure 4B:
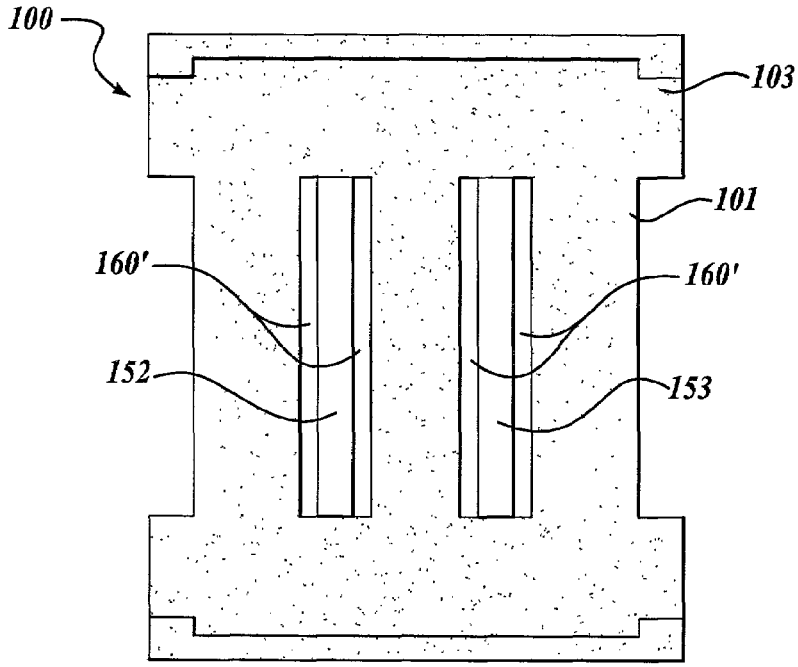
FIG. 4B illustrates a top view of the substrate illustrated in FIG. 4A having a plurality of cavities etched therein.
Figure 4C:
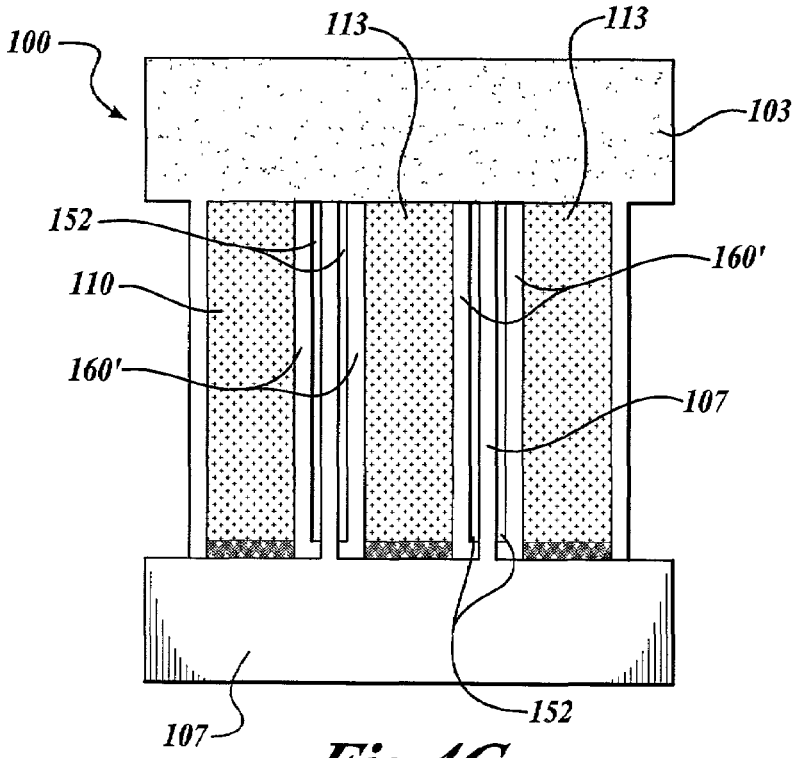
FIG. 4C is a top view of the substrate illustrated in FIG. 4A having a grid component applied thereon.
Figure 4D:
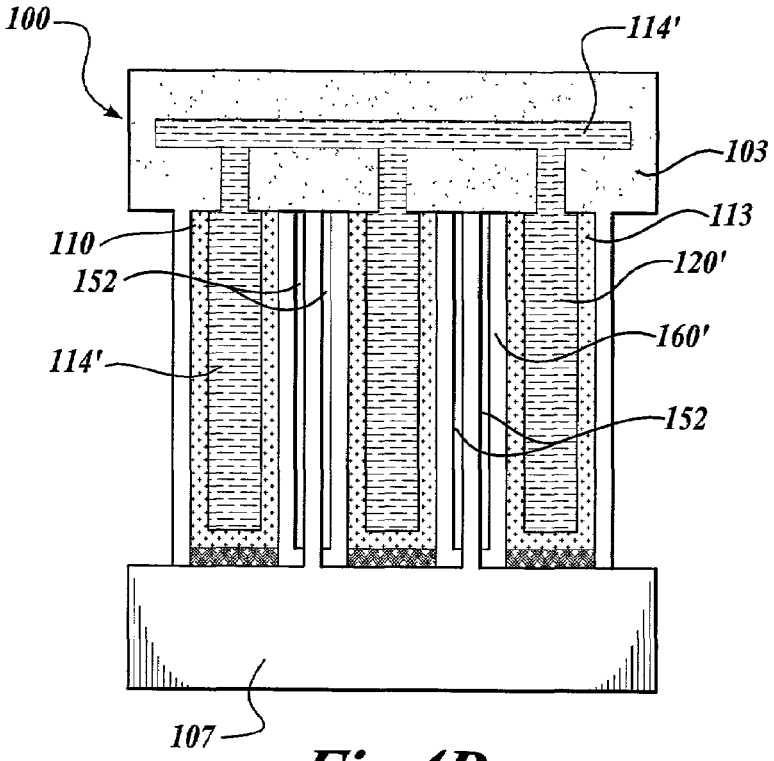
FIG. 4D is a top view of the substrate illustrated in FIG. 4A having an anode component.

In one embodiment, the anode structure may be in the form of a conductive layer shaped into elongated electrodes, such as those shown in FIG. 4D. As shown in FIG. 4D, the shaped anode structure 114' comprises a number of elongated electrodes that are sized to span over the length of the air bridge surface covered with the electron-emitting material 110. In one embodiment, each electrode is vertically positioned above the cathode of the device.

In other alternative embodiments, the grid and/or anode can be disposed and patterned on other intermediate or base layers, such as an insulating layer. In several examples, an intermediate or base layer supporting the grid and/or anode may be made from a ceramic material, glass, semiconductor, conductor, metal, other like materials or combinations thereof. In these alternative embodiments, such intermediate or base layers may be made from any known additive or subtractive technique. Alternatively, the grid or anode may be formed or disposed onto a supporting layer by the use of any known fabrication process. For example, the grid or anode can be formed by electroplating, evaporation, metal sputtering, or any other like method. In addition, the grid or anode may be further shaped by a process involving a sacrificial layer or substrate, photolithography, patterning, etching, lift-off, chemical-mechanical polishing, and other such processes. The grid or anode may be composed of a single material, a single layer of material, multilayers of materials, alloys, compounds, or the like. For example the grid or anode may be made from materials such as tungsten, gold, nickel, molybdenum, silver, copper, or tantalum, or any other like material. In addition, the grid or anode may be made from carbon-containing materials, silicides, or the like.

Once the anode, referred to as conductive layer 120', and the second substrate 121 are combined, thereby forming the anode structure 114', the conductive layer 120 is positioned over the cathode 113 and grid 107. Although this illustrative embodiment involves an anode structure 114' that is vertically positioned over the cathode 113 and grid 107, the anode structure 114' can be in any position relative to the cathode 113 and grid 107 so long as the anode structure 114' is in a position such that it can receive electrons emitted by the cathode 113.

After the cathode 113, grid 107, and anode structure 114 have been formed and positioned, the anode structure 114 is affixed to the base substrate 101. In one embodiment, the anode structure 114 is affixed to a raised border, such as the supporting wall 154, formed on the periphery of the substrate 101. In this embodiment, the anode structure 114 is affixed to the supporting wall 154 in a manner that creates an enclosed environment around the cathode 113, grid 107, and conductive layer 120 of the anode 114. The anode structure 114 is preferably sealed to the base substrate 101, where the seal is of suitable strength for supporting a controlled environment in the enclosure. In one embodiment, the anode structure 114 is hermetically sealed to the base substrate 101 by the use of any suitable fusing or sealing process. As can be appreciated by one of ordinary skill in the art, any known prior art process may be used to affix the anode structure 114 to the base substrate 101 for creating a controlled environment around the device components. In addition, the anode structure 114 may be attached to the base substrate 101 by any other structure that is used in place of, or in conjunction with, the supporting wall 154. For instance, any material having sufficient strength for supporting a vacuum environment may be used to attach the anode structure 114 to the base substrate 101. In such an embodiment, for example, a semiconductor or glass material may be hermetically sealed between the anode structure 114 and base substrate 101.

In an alternative embodiment of the anode structure 114, as shown in FIG. 1, the anode structure 114 may include a conductive layer 120 that covers one continuous surface area above the cathode 113 and grid 107. Accordingly, the conductive layer 120 of the anode structure 114 may cover a continuous surface area having an outer boundary defined by the edge of the supporting wall 154.

To create the controlled environment, all gases, such as oxygen and other impurities, are drawn from volume surrounding the cathode, anode, and grid before the anode structure 114 is sealed to the base substrate 101. Once the vacuum environment is created within the enclosed environment, the seal is created between the anode structure 114 and the base substrate 101. Although one illustrative embodiment of creating an enclosure is shown, the anode structure 114, second substrate 121, and the base substrate 101 may be configured in any shape or form so long as each component is sufficiently shaped and configured to support a controlled environment surrounding the device components.

In other embodiments, the controlled environment surrounding the anode structure 114, grid 107 and cathode 113 may be in other forms that allow electrons to communicate between each component of the triode 100. For example, the enclosed area internal to the supporting wall 154 and anode structure 114 may be filled with a gas such as hydrogen, helium, argon or mercury.

Referring now to FIGS. 4A–4D, the top view of various components of the triode 100 are shown. As described in more detail above and shown in FIG. 4A, one illustrative example of a triode 100 comprises a formed substrate 101 having a first support 152, second support 153, and a supporting wall 154. FIG. 4B illustrates a top view of the formed substrate 101 having slotted cavities 160' etched therein. In addition, FIGS. 4C and 4D respectively illustrate a top view of one embodiment of the grid 107 and anode structure 114'.

The illustrative example depicted in FIGS. 4A–4D shows one embodiment of a SSVD that comprises three formed cathodes positioned on each side of the supports 152 and 153. This illustrative embodiment shows that the components disclosed herein accommodate a SSVD design having an array of devices, such as an array of triodes, tetrodes or pentodes, or combinations thereof. Accordingly, additional cathodes and supports can be added to the structure of FIGS. 4A–4D in a configuration similar to the array of cathodes described below.

Referring now to FIG. 4A, various aspects of the formed substrate are shown and described. As shown in FIG. 4A, the first support 152 and second support 153 are each formed into a generally elongated ridge having a narrowed top surface for supporting additional device components. Also shown in FIG. 4A, the elongated ridges created by each support 152 and 153 are substantially parallel to one another. FIG. 4A also illustrates one orientation of the supporting wall 154. As shown, the supporting wall 154 is formed along the periphery of the substrate 101.

FIG. 4B illustrates a top view of one embodiment of the slotted cavities 160' and oxidation layer 103 of the triode 100. As described above, the oxidation layer 103 is applied over the horizontal and vertical surfaces of the form substrate 101. Accordingly, the oxidation layer 103 forms a uniform surface over the top portions of the first and second supports 152 and 153 and the top surface of the base of the substrate 101. As described above and as shown in FIG. 4B, each slotted cavity 160', in one embodiment, can be configured into an elongated rectangular groove. Each slotted cavity 160' is positioned such that the sides of the grooves are parallel to the sides of each support 152 and 153. As described above, each slotted cavity 160' forms an opening through the oxidation layer 103 that allows for the removal of the substrate material underneath the oxidation layer 103.

FIG. 4C illustrates a top view of one embodiment of the grid 107. In addition, FIG. 4C illustrates the orientation and shape of the electron-emitting material 110 disposed on the air bridge structure. As described above with reference to FIG. 3D, the grid 107 includes a conductive layer that is selectively disposed on the top of each support 152 and 153. As shown in FIG. 4C, the grid 107 is formed into a number of thin strips of a conductive material that are shaped and positioned to cover the top surfaces of each support 152 and 153. The elongated strips of conductive material that form the grid 107 extend over a substantial portion of or beyond each support 152 and 153. In the embodiment shown in FIG. 4C, the width of each elongated strip does not exceed the width of the respective support on which it rests. In other alternative embodiments, such as the grid 107 shown in FIGS. 1 and 3D, the width of each elongated strip of the grid 107 is equal to or greater than the width of the support on which it rests.

Also shown in FIG. 4C, the electrically conductive material that forms the grid 107 may extend from each support 152 and 153 to a portion of the substrate 101 that allows for electrical communication with an external circuit. In this illustrative embodiment, the grid 107 covers a surface area that extends along at least one edge of the substrate 101, thereby forming an external contact surface.

Referring now to FIG. 4D, a top view of the triode 100 is shown and described below. As illustrated in FIG. 4D, the top view reveals one embodiment of the relative position and shape of the various layers that make up the anode 114', cathode 113 and grid 107. As can be appreciated by one of ordinary skill in the art, each layer is separated by an insulating layer and configured to allow an external electrical circuit to independently connect to each component 114', 113, and 107.

As shown in FIG. 4D, one embodiment of a formed anode structure 114' is shown. In this embodiment, the formed anode structure 114' is made of a shaped conductive layer 120' and a substrate (not shown). For illustrative purposes the top view of FIG. 4D only illustrates the conductive layer 120' of the formed anode structure 114'. As shown, the conductive layer 120' is formed into a number of elongated members that are each configured in a shape that may be substantially similar to the shape of the cathode 113. Each elongated member of the shaped conductive layer 120' is respectively vertically positioned over a cathode 113. In one embodiment, the conductive layer 120' is configured to extend over a substantial portion of the cathode 113. In this embodiment, the width of the formed anode structure 114' is equal to or less than the width of the cathode. In another embodiment, the width of the formed anode structure 114' may be greater or equal to the width of the cathode.

In yet another embodiment of the anode structure 114, the conductive layer of the may be configured into a single conductive layer that covers one continuous surface area over the grid 107 and cathode 113. As shown in FIG. 1, this embodiment may involve a conductive layer that is configured to extend to each supporting wall of the device, thereby creating one continuous conductive layer over the cathode 113 and anode 107. Although several illustrative embodiments of the anode 107 are described herein, as can be appreciated by one skilled in the art, the anode 107 may be formed into a large variation and a number of embodiments.

Figure 5A:
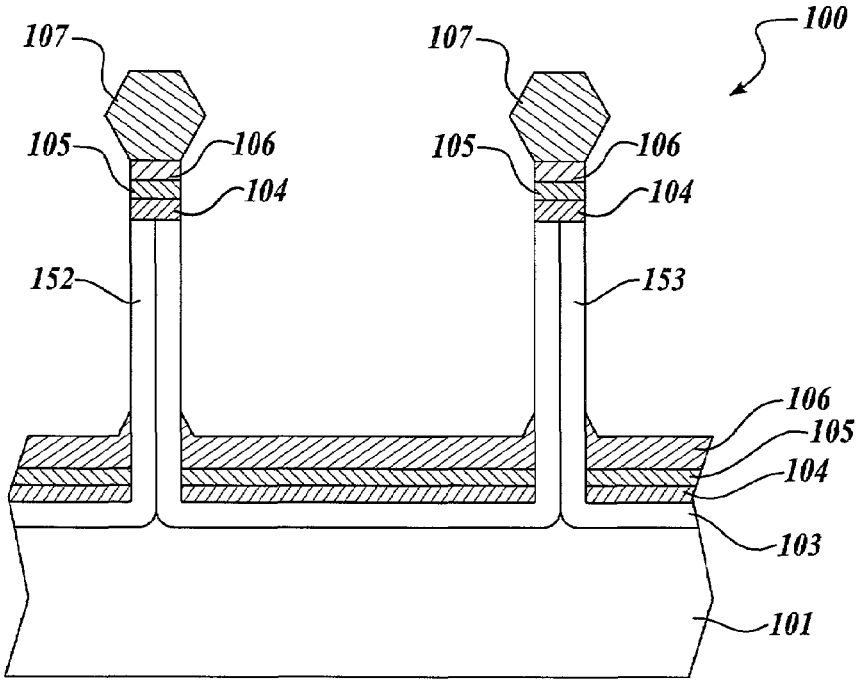
FIGS. 5A–5C illustrate several steps of another embodiment of a fabrication process for forming a device.
Figure 5B:
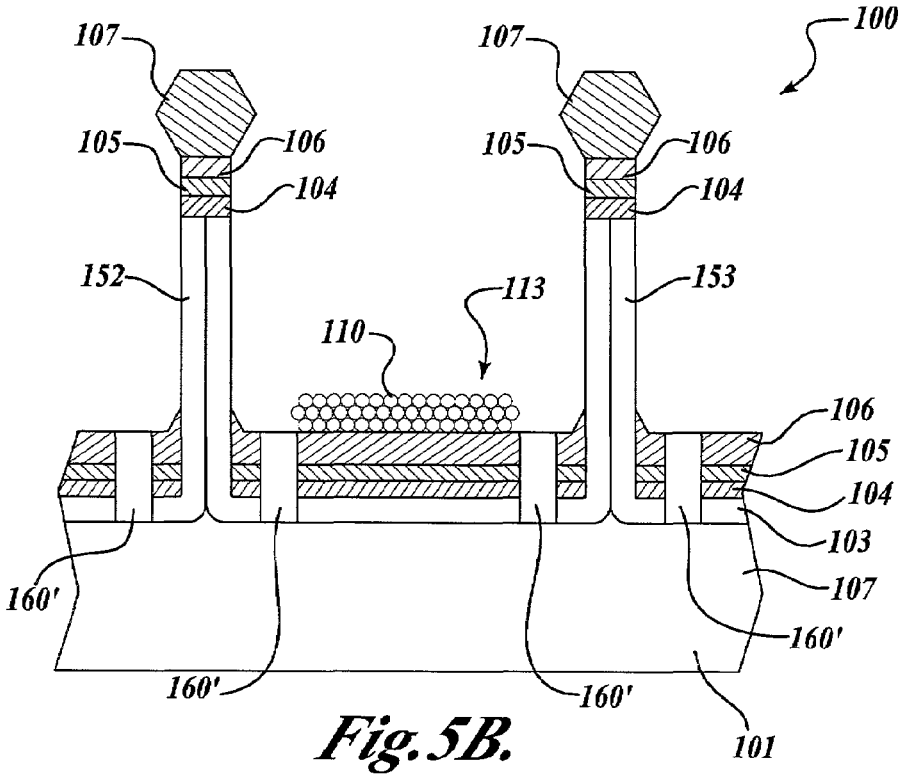
Figure 5C:
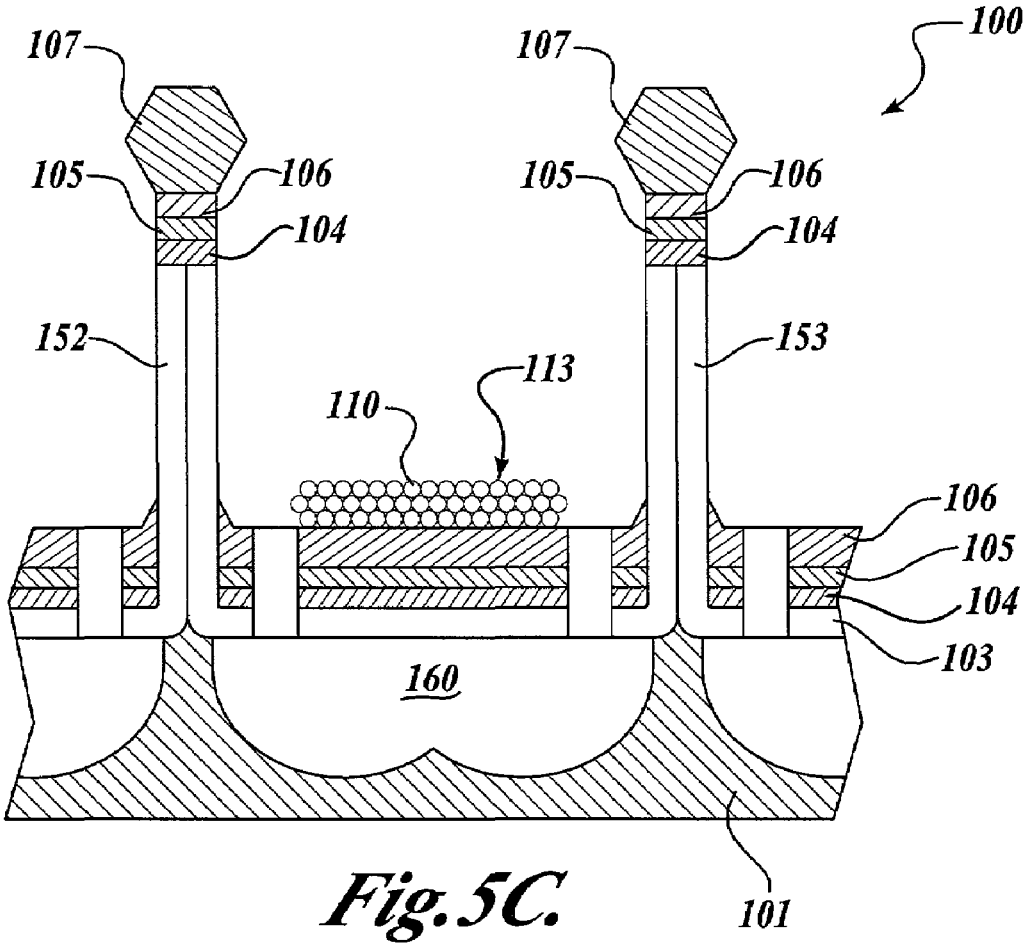

Referring now to FIGS. 5A–5C, another embodiment of a fabrication process for forming a triode 100 is shown and described below. In general, the triode 100 depicted in FIGS. 5A–5C includes the same device components as the triode 100 depicted in FIG. 1. In general, this embodiment of the fabrication process for producing the triode 100 utilizes a number of process steps as described above with reference to FIGS. 3A–3D. As described in more detail below, this embodiment of the fabrication process involves the formation of the insulation and conductive layers 103–106 on the substrate 101 before the cavity 160 is formed in the substrate 101. This embodiment allows the substrate 101 to support the components of the air bridge structure during the application of each layer 103–106 and 110 of the cathode 113.

As shown in FIG. 5A, this embodiment of the fabrication process starts by forming an oxidation layer 103 on the surface of the substrate 101 by the use of a process that is similar to the fabrication process described above with reference to FIGS. 3A–3D. Next, this embodiment of the fabrication process involves the application of the first conductive and second electrically insulating layer 104 and 105, respectively. The conductive first and second layers, 104 and 105, are respectively applied onto the oxidation layer 103 by the use of fabrication processes that are similar to the fabrication process described above. This embodiment of the fabrication process also involves the application of a second conductive layer 106, which is disposed on the second insulating layer 105. As described above, the insulating layer 105 can be formed onto the conductive layer by any known process, such as sputtering, electron beam evaporation, wet oxidation. The electron-emitting material 110, grid 107 and slotted cavities 160' are formed by the use of any one of the above-described fabrication processes. The slotted cavities 160' of this embodiment may be formed in a shape and configuration similar to the slotted cavities 160' described above with reference to FIGS. 3C and 3D. In this embodiment, the slotted cavities 160' are etched through the plurality of layers 103–106.

After the formation of the slotted cavities 160', as shown in FIG. 5C, the substrate cavity 160 is formed under a portion of the oxidation layer 103 that is positioned between the first and second support 152 and 153. The substrate cavity 160 can be formed by any one of the above-described etching techniques, such as dry or wet etching. By the use of the fabrication process of FIGS. 5A–5C, the air bridge structure is properly formed during the application of the various layers 103–106 and 110 of the cathode.

Referring now to FIGS. 6A–6D, another embodiment of a fabrication process for forming a device 200 is shown and described below. In general, this embodiment depicted in FIGS. 6A–6D comprises a plurality of masking steps to form a plurality of stacked supports that form the grid 209 and cathode 212 of the device 200. As will be described in more detail below, this embodiment of the device 200 may be utilized in the construction of a cathode and grid that may be used to form a diode, triode, or any other higher order device.

Figure 6A:
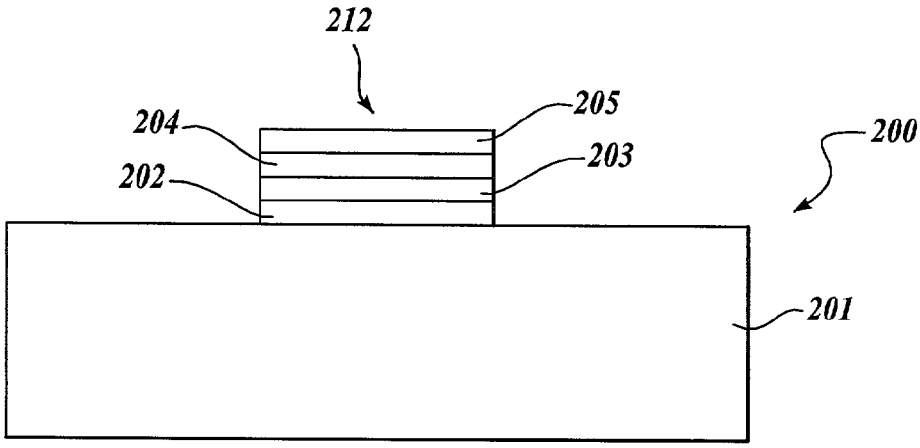
FIGS. 6A–6D illustrate several steps of yet another embodiment of a fabrication process forming a stacked structure of a cathode and grid of yet another device.

Referring now to FIG. 6A, this embodiment of the fabrication process begins with a base substrate 201. In one embodiment, the substrate 201 may be formed into any desired shape but is preferably shaped to have a substantially flat top surface. The substrate 201 may be made from any base material such as a single crystal, polycrystalline material, amorphous material, or any other appropriate substrate material depending on the application.

In the first part of the fabrication process, components 202–205 of the cathode 212 are disposed onto the substrate 201. In several embodiments of the fabrication process, the substrate 201 is first cleaned in accordance with standard substrate cleaning techniques. Next, one of the planar surfaces of the substrate 201 is then covered with a patterned spacing layer 202. The patterned spacing layer 202 can be made of any conventional masking material such as silicon nitride, silicon dioxide, or any appropriate polymer. In another embodiment, the patterned spacing layer 202 can be made from a composite layer of silicon nitride overlying a layer of silicon dioxide. The patterned spacing layer 202 can be configured to any desired thickness; however, in one embodiment the patterned spacing layer 202 is formed with a thickness of 0.1 micron to 1 millimeter.

Figure 6B:
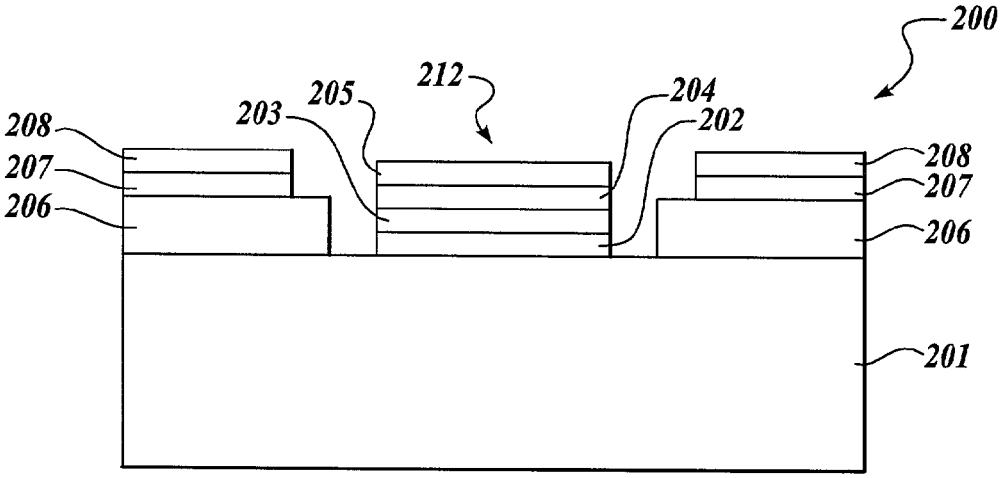

As shown in FIG. 6A, the patterned spacing layer 202 is shaped into a desired configuration to form the base of the cathode 212. With reference to FIGS. 6A–6B, one embodiment of the cathode 212 is formed into a generally elongated rectangular member having a sufficient length to form a suspended air bridge structure that extends over a cavity in the substrate 201. Any conventional or novel masking process may be employed in forming the patterned spacing layer 202 such as those described above with reference to FIGS. 3A–3D. In one embodiment, an etching process employing hydrofluoric (HF) acid can be used to properly shape the patterned spacing layer 202.

Subsequent to the processing of the patterned spacing layer 202, the surface of the patterned spacing layer 202 may be then exposed to a masking process for disposing a first conductive layer 203 on top of the patterned spacing layer 202. As shown in FIG. 6A, the first conductive layer 203 may be formed into a shape that is substantially similar to the shape of the patterned spacing layer 202. In one embodiment, this part of the process involves the application of a layer of chromium, and depending on the particular embodiment, the application of the chromium is followed by additional conductive layers such as tungsten. Although chromium and tungsten are utilized in this illustrative example, any other appropriate electrically conductive material, non-conductive material, transition metal, or combinations thereof may be used in this part of the fabrication process.

The process continues with the application of a second conductive layer 204. In one embodiment, this part of the process involves the application of a thin layer of tungsten that is directly applied or applied with a suitable intermediate layer on the first conductive layer 203. Although tungsten is utilized in this illustrative example, nickel or materials having like properties may be used in this part of the fabrication process. Similar to the first conductive layer 203, an electrically insulating layer 204 is preferably formed into a shape that is substantially similar to the shape of the patterned spacing layer 202. Next, a second conductive layer 205 is disposed onto the electrically insulating layer 204. In one embodiment, the second conductive layer 205 is a thin layer of chromium followed by a layer of tungsten. It should be appreciated and understood that each of the individual layers may consist of a number of sublayers of different materials, which preferably convey the same material properties.

The above-described shaped layers 202–205 may be formed by the use of any fabrication process or processes for shaping oxidation and metallic layers. In one embodiment, the shaped layers 202–205 are formed by the use of a photoresist material or any other appropriate material that can be shaped by a mask or molded or patterned. Alternatively, the shaped layers 202–205 that form the foundation of the cathode 212 may utilize other generally known fabrication processes, including those utilizing wet or dry etching techniques.

Referring now to FIG. 6B, a plurality of insulating and conductive layers 206–208 utilized in the construction of the grid support structure are shown. In this part of the process, an insulating layer 206 is applied onto the planar surface of the substrate 201 on opposite sides of the cathode foundation to form a raised surface for the grid. In one embodiment, the insulating layer 206 is formed into an elongated member that is positioned near the foundation of the cathode 212, where the elongated side of the insulating layer 206 is substantially parallel to the elongated side of the cathode foundation. In one specific embodiment, the insulating layer 206 may be formed in an elongated rectangular shape similar to the shape of the first and second supports 152 and 153 as shown in the top view of FIG. 4B. Also as illustrated in the top view of FIG. 4B, in certain embodiments, the distance between the foundation of the cathode 212 and insulating layer 206 should be sized to allow for the etching of the substrate surface between the foundation of the cathode 212 and insulating layer 206. The insulating layer may be applied to the substrate 201 by any known technique, including: CVD, PVD, anodic oxidation, spin-on-glass (SOG) techniques, or thermal or other growth techniques. In methods where the SOG is used, the SOG may be cured in a nitrogen-purged oven. Other known processes for producing the above-described structures are also within the scope of the present invention.

Returning now to FIG. 6B, this embodiment of the fabrication process also involves the application of third and fourth conductive layers 207 and 208. More specifically, the third and fourth conductive layers 207 and 208 are respectively formed on the top of the insulating layer 206. In one embodiment, the third and fourth conductive layers are each formed into an elongated member having a shape that is substantially similar to the insulating layer 206. In one embodiment, the third conductive layer 207 may be made from a number of materials, including chromium and/or other metals and elements. The fourth conductive layer 208 may be made of any conductive material such as nickel, tantalum, silver, molybdenum, gold, copper, tungsten, platinum, or any other like material. In addition, the conductive layer 208 may be made from carbon-containing materials, silicides, or other appropriate materials.

In one embodiment, the third and fourth conductive layers 207 and 208 each have a thickness between 1 nanometer and 1 mm. It should be understood and appreciated that layers less than 1 nanometer or greater than 1 mm may be employed in other embodiments. The third and fourth conductive layers 207 and 208 may be applied by any known fabrication processes for defining, shaping, and/or creating formed metallic layers. For instance, the third and fourth conductive layers 207 and 208 may be applied onto the insulating layer 206 by a sputtering technique. Once the third and fourth conductive layers 207 and 208 are disposed onto the insulating layer 206, the wafer may be exposed to an acetone bath, which employs ultrasonic techniques for agitation. It should be appreciated that some embodiments of the supports may only comprise one layer 207 or 208. In addition, it can be appreciated that other embodiments may comprise more than two distinct layers, such as the two layers referred to as 207 and 208. Thus, any single or multiple layered structure may be used to form the supports of the device 200, and such structures providing thermal and electrically insulative properties may be used.

Figure 6C:
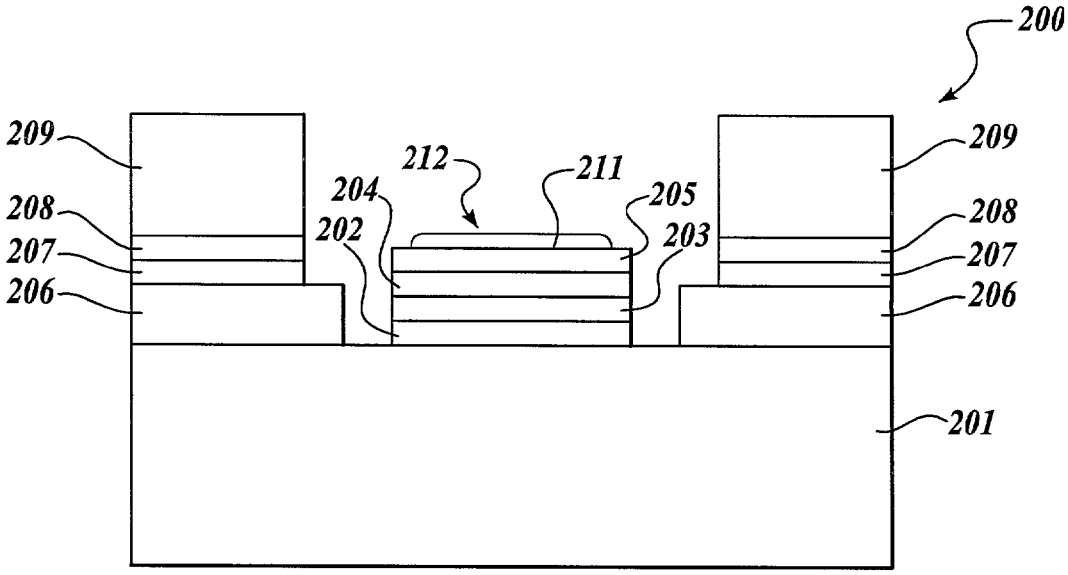

Following the application of the third and fourth conductive layers 207 and 208, as shown in FIG. 6C, a grid 209 is applied directly onto the fourth conductive layer 208. Similar to the grid 107 shown in the top view of FIG. 4D, the grid 209 of this embodiment may be formed into an elongated rectangular pattern, where one side of the elongated rectangle is substantially parallel to one side of the formed cathode. In one embodiment, the grid 209 is formed to have a thickness of less than one nanometer to a thickness of greater than one millimeter. In one specific embodiment, the grid 209 is configured to have a thickness between 1 and 20 microns. Similar to the embodiments described above, the grid 209 may be made from any conductive material. For example, the grid 209 may be made of nickel, tungsten, molybdenum, platinum, tantalum, titanium, or any other like material. In one embodiment, a photoresist known in the art as AZ4620 is used as the mold material for applying the grid 209. In one embodiment involving a nickel grid material, nickel electroplating is used to raise the height of the grid 209, which increases the gain of the device 200. In other embodiments, layers 207 and 208, or any other suitable component, may be utilized to raise the height of the grid 209.

In the construction of the cathode 212, an electron-emitting material 211 is applied directly onto the second conductive layer 205. As described above, with the embodiment shown in FIG. 3D, the electron-emitting material 211 may be made from any appropriate material or metal including a low work function material, such as a trioxide coating comprised of oxides of barium, strontium, and calcium. In alternative embodiments, the low work function material may be a BaSr bicarbonate or a material comprising barium, strontium and aluminum. Thoriated tugsten, scandate, and scandia may also be included in other embodiments of the low work function material. As described above, with reference to the cathode 113 depicted in FIG. 3D, the electron-emitting material 211 is uniformly applied to the surface of the second conductive layer 205 by the use of the above-described fabrication techniques.

Figure 6D:
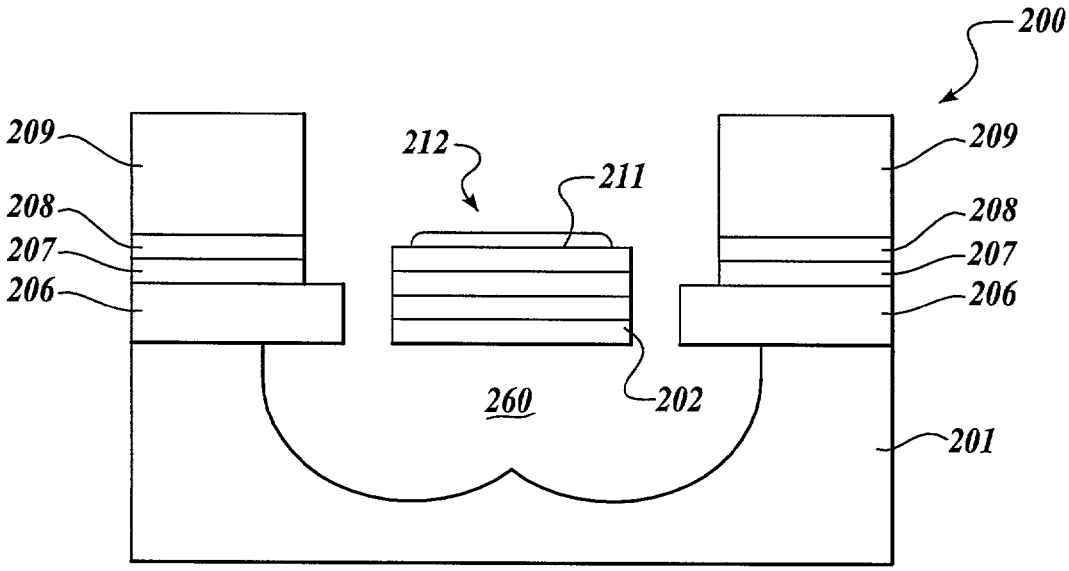

Referring now to FIG. 6D, the fabrication process of this embodiment also includes a step, or steps, that form a cavity 260 in the substrate 201 is shown and described. In one embodiment, the cavity 260 is formed in a shape and depth that is substantially similar to the shape and depth of the cavity 160 of the triode 100 shown in FIG. 1. The cavity 260 of this embodiment is formed underneath a substantial portion of the patterned spacing layer 202 thereby forming a cathode 212 having a suspended air bridge structure. The cavity 260 can be in any form or shape, but is preferably formed such that an air gap is created between a substantial portion or all of the cathode 212 and the substrate 201. As described above, the air gap created by the cavity 260 provides thermal isolation between the cathode 212 and substrate 201.

In this embodiment of the fabrication process, the cavity 260 is etched in the substrate 201 by the use of a fabrication process that is similar to the above-described fabrication process used to form the cavity 160 as shown in FIG. 1. For instance, the formation of the cavity 260 may employ the above-described dry and wet etching processes.

The illustrative example of the device 200 is not intended to be exhaustive or to limit the invention to the precise form disclosed herein. Although the device 200 shown in FIG. 6D is disclosed as one illustrative embodiment of the present invention, the device 200 may be made from a variety of different layers or combination of layers to form the cathode 212, grid support structure 206–208 and grid 209. For instance, as described above with reference to FIG. 3D, the cathode 212 can comprise a combination of conductive and insulating layers to employ direct or indirect cathode heating methods.

Now that several fabrication processes of various solid-state vacuum devices have been described in detail, several alternative embodiments of other solid-state vacuum devices will now be shown and described. More specifically, FIGS. 7–9 respectively illustrate other devices such as a tetrode, pentode and diode. As can be appreciated by one of ordinary skill in the art, the above-described fabrication processes provide unique techniques that allow for the construction of a diode, triode, tetrode, pentode, power tetrode, and any other higher order device.

Figure 7:
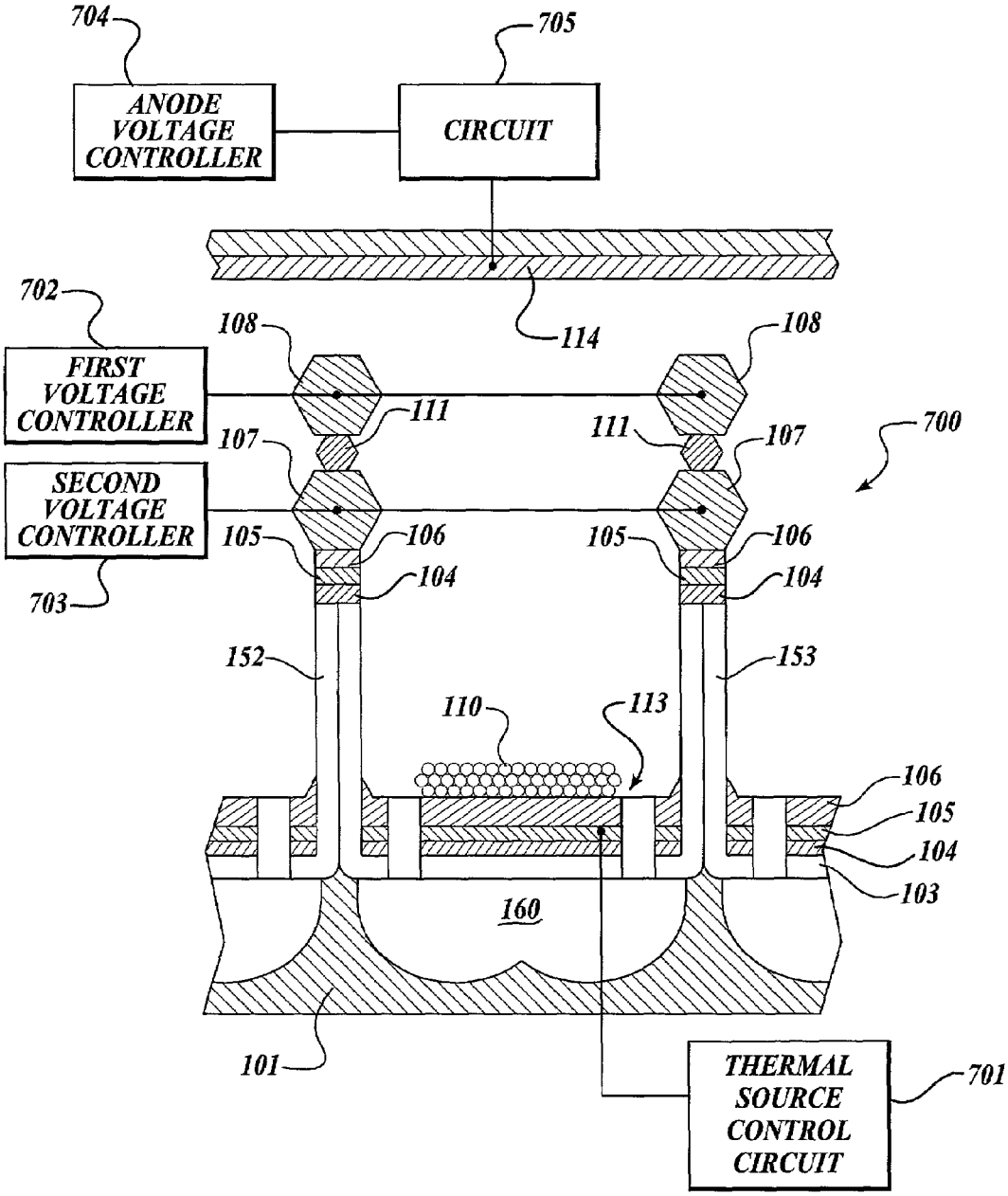
FIG. 7 is a front cross-section view of one embodiment of a device forming a tetrode.

Referring now to FIG. 7, another embodiment of a solid-state vacuum device forming a tetrode 700 is shown and described below. Generally described, the tetrode 700 comprises the general components of the triode 100 illustrated in FIGS. 3D and 5C. More specifically, the triode 700 comprises an anode 114, cathode 113, and a substrate 101 having a cavity 160 formed under the cathode 113. In addition, the tetrode 700 comprises an insulating layer 103, first conductive layer 104, second insulating layer 105, and second conductive layer 106 that are each configured in a manner similar to the triode 100 of FIG. 3D. As can be appreciated by one of ordinary skill in the art, each of these components can be formed and positioned by the use of any suitable fabrication including any one or more of the fabrication processes described above.

In the fabrication process of the tetrode 700, an insulating layer 111 is applied to the top surface of the grid 107. The insulating layer 111 may be made from any material that has desired electrically insulating and resistive properties. The insulating layer 111 is preferably formed to a thickness that provides sufficient electrical insulation between the grid 107 and any other conductor applied on top of the insulating layer 111. With reference to FIG. 7, the insulating layer 111 is formed into an elongated member of sufficient size to cover the top surface of the grid 107.

Subsequent to the application of the insulating layer 111, the fabrication process of the tetrode 700 further comprises the application of a second grid 108. In this embodiment, the second grid 108 is made from a conductive material that is applied on the top surface of the insulating layer 111. This second grid 108 is formed on top of the insulating layer 111 by the use of any suitable fabrication process or processes including any one of the above-described fabrication processes associated with the application of the first grid 107. For instance, the second grid 108 may be formed by a seal-less or sealed layer electroplating process.

Also illustrated in FIG. 7, the various circuit components utilized the operation of a solid-state vacuum device, such as the tetrode 700, are shown and described below. As shown in FIG. 7, a thermal source control circuit 701 is electrically connected to the conductive layer 104, also referred to as the thermal source 104. The thermal source control circuit 701 supplies a voltage to the conductive layer 104 causing the conductive layer 104 and indirectly the electron-emitting material 110 to heat. Once brought to a sufficient temperature, the electron-emitting material 110 emits electrons, which are ultimately received by the anode 114. In another embodiment used for directly heated cathodes, layers 105 and 106 may be absent. In other embodiments layers 103, 105, 106 may be absent.

Also shown in FIG. 7, an anode voltage controller 704 is electrically connected to the anode 114 for providing the anode 114 with a positive voltage to attract the electrons emitted from the electron-emitting material 110. As described above, in response to receiving electrons, the anode 114 produces an electrical current that can be utilized by a circuit 705. A first voltage controller 702 is connected to one grid layer 108 and a second voltage controller 703 is electrically connected to the other grid layer 107. Similar to a control circuit of a traditional tetrode formed in a vacuum tube, the first and second voltage controllers 702 and 703 provide a varied voltage signal to the grid layers 107 and 108 to control the flow of electrons received by the anode 114. In other embodiments, one voltage controller, such as the second voltage controller 703, may be coupled to a ground source. Accordingly, the amount of electrons received by the anode 114 effectively controls the current produced for the circuit.

Although this illustrative embodiment illustrates a tetrode having two independent voltage controllers for each grid, other embodiments having one or more control circuits can be used to control any number of grid layers of the solid-state vacuum devices disclosed herein. As can be appreciated by one of ordinary skill in the art, the above-described circuit configuration may be applied to other circuits such as a diode, triode, or pentode. For instance, in the application of the triode 100, one alternative embodiment of the control circuit may be substantially similar to the configuration shown in FIG. 7; however, this alternative embodiment of the control circuit typically only includes one voltage controller attached to the grid 107.

As described above, other higher order devices can be implemented by the use of the fabrication methods described herein. Hence, alternative embodiments of the fabrication processes are modified to form additional grid layers to the above-described device embodiments, thus yielding other device configurations having an increased power capacity. For example, FIG. 8 illustrates one embodiment of a pentode 800 that is made by adding a grid layer 109 to the tetrode embodiment of FIG. 7.

Figure 8:
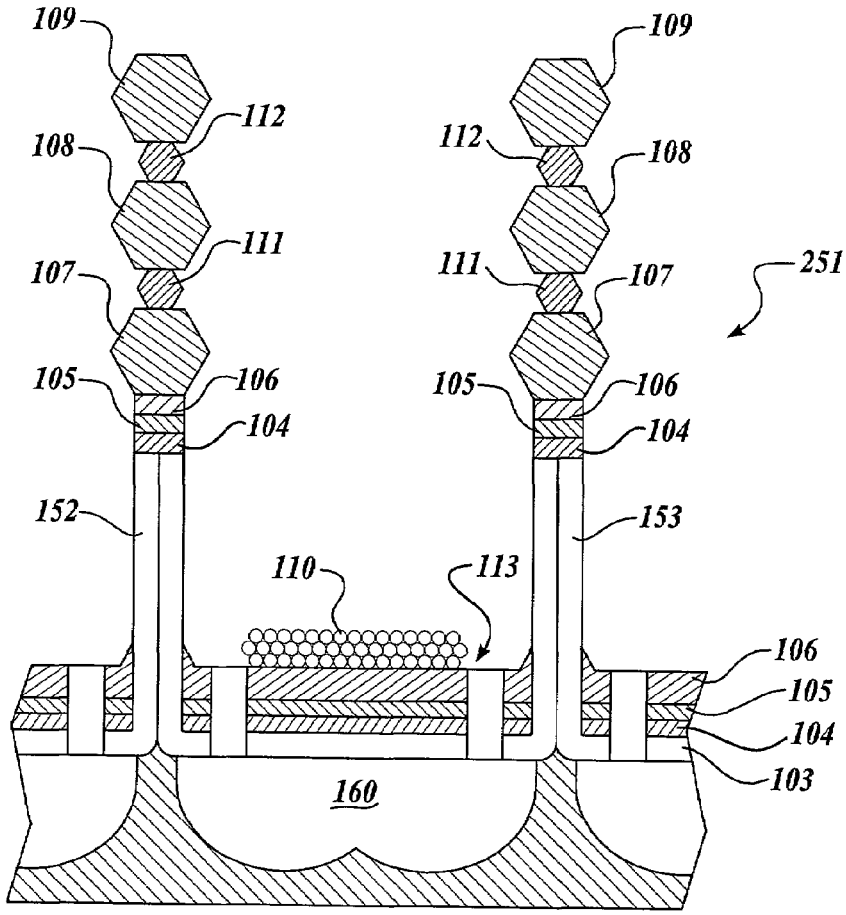
FIG. 8 is a front cross-section view of one embodiment of a device forming a pentode.

In the illustrative embodiment shown in FIG. 8, the pentode 800 comprises the general components of the tetrode 700 illustrated in FIG. 7. More specifically, the pentode 800 comprises an anode (not shown), cathode 113, and a substrate 101 having a cavity 160 formed under the cathode 113. In addition, the pentode 800 comprises an insulation layer 103, first conductive layer 104, second insulation layer 105, and a second conductive layer 106 that are each configured in a manner similar to the tetrode 700. As can be appreciated by one of ordinary skill in the art, each of these components can be formed and positioned by the use of any one of the fabrication processes described above.

In the fabrication process of the pentode 800, a second insulating layer 112 is applied to the top surface of the second grid 108. The second insulating layer 112 may be made from any material that has electrically resistive properties. The second insulating layer 112 is preferably formed to a thickness that provides sufficient electrical insulation between the second grid 108 and any other conductor applied on top of the second insulating layer 112. With reference to FIG. 8, the second insulating layer 112 is formed into an elongated member of sufficient size to cover the appropriate part of top surface of second grid 108. The second insulating layer 112 is formed on top of the first grid 107 by the use of any one of the above-described fabrication processes describing the application of the insulation layer 106 under the first grid 107.

Subsequent to the application of the second insulating layer 112, the fabrication process of the pentode 800 further comprises the application of a third grid 109. In this embodiment, the third grid 109 is made from a conductive layer that is applied on the top surface of the second insulating layer 112. The third grid 109 is formed on top of the second insulating layer 112 by the use of any one of the above-described fabrication processes describing the application of the first grid 107. For instance, an electroplating process may form the third grid 109.

Figure 9:
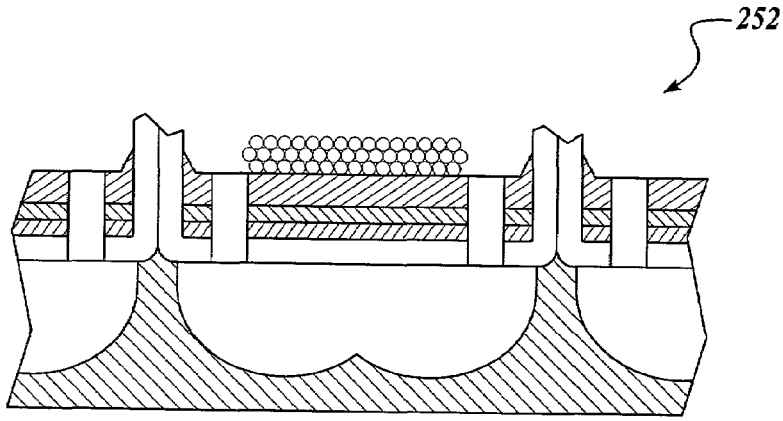
FIG. 9 is a front cross-section view of one embodiment of a device forming a diode.

Referring now to FIG. 9, another illustrative embodiment of a solid-state vacuum device forming a diode 900 is shown and described below. In general, the diode 900 comprises the general components of the triode 100 illustrated in FIGS. 3D and 5C. More specifically, the diode 900 comprises a cathode 113, an anode positioned above the cathode 113 (not shown), and a substrate 101 having a cavity 160 formed under the cathode 113. In addition, the diode 900 comprises an insulation layer such as an oxidation layer 103, first conductive layer 104, second insulation layer 105, and an second conductive layer 106 that are each configured in a manner similar to the triode 100 of FIG. 3D. As can be appreciated by one of ordinary skill in the art, each of the diode 900 components can be formed and positioned by the use of any one of the fabrication processes described above.

As shown in FIG. 9 and in view of the fabrication process shown in FIGS. 3A–3D, the fabrication of the diode 900 does not require the steps of forming the grid 107. Alternatively, the fabrication of the diode 900 utilizes the fabrication process of FIGS. 3A–3D and further comprises additional fabrication steps to remove the grid layer 107. Accordingly, a diode 900 having a cathode 113 and anode (not shown) suspended above the cathode 113 may be formed by any of the above described fabrication processes.

While several embodiments of the invention have been illustrated and described, it will be appreciated that various changes can be made therein without departing from the spirit and scope of the invention. Similarly, any process steps described herein might be interchangeable with other steps in order to achieve the same result. In addition, the illustrative examples described above are not intended to be exhaustive or to limit the invention to the precise forms disclosed. For instance, as suggested by the cut-away view of FIG. 1, one embodiment of a solid-state vacuum device may comprise an array having a number of diodes, triodes, or any other higher-order devices combined onto one substrate. By fabricating duplicate devices, or various combinations thereof, on one substrate, high-power solid-state vacuum device can be formed. In such a modification, each individual device should be separated and insulated from one another by the use of gaps or voids. In addition, such device arrays can be separated by a thermal insulator such as ceramic, silicon dioxide, sapphire, or the like.

The embodiments of the invention in which an exclusive property or privilege is claimed are defined as follows:

1. A thermionic emission device, comprising:

a substrate having a cavity extending into a surface of the substrate;

a cathode having an electron-emitting coating disposed thereon, the cathode suspended near the cavity in the substrate;

an anode constructed of an electrically conductive material, wherein the anode is configured to receive electrons emitted by the cathode;

an elongated grid supported by at least one elongated wall-shaped support extending perpendicularly from the substrate, the wall-shaped support configured to be free standing and not supporting the anode, the elongated grid forming at least one aperture configured for allowing the passage of electrons therethrough and wherein the elongated grid is positioned between the cathode and the anode, but not directly in a path for electrons to travel from the cathode to the anode;

a seal for creating a controlled environment in an area surrounding the anode, the cathode, and the elongated grid; and a circuit configured for heating the cathode.

2. The device of claim 1 further comprising, at least one control circuit for selectively supplying a voltage to the grid to control the magnitude of the flow of electrons through the at least one aperture of the grid, thereby controlling the electrical current received by the anode.

3. The device of claim 1, wherein the grid further comprises a plurality of elongated conductive strips, wherein the plurality of elongated conductive strips are substantially parallel to one another, and wherein the at least one aperture of the grid is formed by the spacing between the plurality of elongated conductive strips.

4. The device of claim 1, wherein the at least one elongated support comprises a stacked structure.

5. The device of claim 1, wherein the cathode is affixed to the substrate at opposite ends of the cathode, and wherein a substantial portion of the cathode is suspended over the cavity of the substrate, thereby forming a gap between the cathode and substrate.

6. The device of claim 1, wherein the electron emitting coating is made of a low work function material.

7. The device of claim 1, wherein the electron emitting coating is made of a BaSrCa tricarbonate.

8. The device of claim 1, wherein the electron emitting coating includes BaSr.

9. The device of claim 1, wherein the electron emitting coating includes BaSrAl.

10. The device of claim 1, wherein the electron emitting coating includes thoriated tungsten.

11. The device of claim 1, wherein the electron emitting coating includes scandia.

12. The device of claim 1, wherein the electron emitting coating includes scandate.

13. The device of claim 1, wherein the electron emitting coating includes cesium.

14. The device of claim 1, wherein the grid is made of material selected from the group consisting of tungsten, gold, nickel, carbon, silver, and copper.

15. The device of claim 1, wherein the grid is made of material selected from the group consisting of molybdenum and tantalum.

16. The device of claim 1, wherein the grid contains a carbon-containing material.

17. The device of claim 1, wherein the grid contains a silicide.

18. The device of claim 1, wherein the controlled environment surrounding the grid, cathode, and anode has a vacuum drawn therein.

19. The device of claim 1, wherein the controlled environment is an enclosed area filled with a gas selected from the group consisting of hydrogen, helium, krypton, argon, and mercury.

20. A thermionic emission device, comprising:

a substrate having a cavity extending into a surface of the substrate;

a first member having an electron-emitting coating, wherein the first member is suspended near the cavity;

a second member constructed of an electrically conductive material configured to receive electrons emitted by the first member and configured to produce an electrical current for an external circuit from the received electrons;

a first elongated grid supported by at least one elongated wall-shaped support extending perpendicularly from the substrate, the wall-shaped support configured to be free standing and not supporting the second member, the first elongated grid forming a first at least one aperture configured for allowing passage of electrons therethrough;

a second elongated grid supported above the first elongated grid and forming a second at least one aperture configured for allowing the passage of electrons therethrough wherein the first elongated grid and the second elongated grid are positioned between the first member and the second member, but not directly in a path for electrons to travel from the first member to the second member;

a seal for creating a controlled environment in an area surrounding the first and second elongated grids and the first and second members; and a circuit configured for heating the first member.

21. The device of claim 20, further comprising, at least one control circuit for selectively supplying a voltage to the first and second elongated grids to control the magnitude of the flow of electrons through the first and second at least one apertures of the first and second elongated grids, thereby controlling the electrical current received by the second member.

22. The device of claim 20, wherein the first and second at least one apertures are aligned.

23. The device of claim 20, wherein the second elongated grid is electrically connected to a ground source.

24. The device of claim 20, wherein the first and second elongated grids each further comprise elongated conductive strips mounted on the at least one elongated support extending perpendicularly from the substrate.

25. The device of claim 20, wherein the first member is affixed to the substrate at opposite ends of the first member, and wherein a substantial portion of the first member is suspended over the cavity of the substrate, thereby forming a gap between the first member and substrate.

26. The device of claim 20, wherein the first and second elongated grids are made of material selected from the group consisting of tungsten, gold, and tantalum.

27. The device of claim 20, wherein the controlled environment is an enclosed area surrounding the first and second elongated grids, the cathode, and the anode, wherein the enclosed area has a vacuum drawn therein.

28. The device of claim 20, wherein the controlled environment is an enclosed area filled with a gas selected from the group consisting of hydrogen, helium, argon, and mercury.

29. A thermionic emission device, comprising:

a substrate having a cavity extending into a surface of the substrate;

a first member having an electron-emitting coating, wherein the first member is suspended near the cavity;

a second member comprising an electrically conductive material and configured to receive electrons emitted by the first member;

a first elongated grid forming a first aperture configured for allowing passage of electrons therethrough;

a second elongated grid forming a second aperture configured for allowing the passage of electrons therethrough;

a third elongated grid forming a third aperture configured for allowing the passage of electrons therethrough, wherein the first, second and third elongated grids are positioned between the first member and the second member, but not directly in a path for electrons to travel from the first member to the second member;

wherein the first, second and third elongated grids are supported by at least one elongated wall-shaped support extending perpendicularly from the substrate that is configured to be free standing and not supporting the second member, a seal for creating a controlled environment in an area surrounding the first, second, and third grid, and the first and second member; and a circuit configured for heating the first member.

30. The device of claim 29, further comprising, at least one control circuit for selectively supplying a voltage to the first, second and third elongated grids to control the magnitude of the flow of electrons through the first, second and third apertures, thereby controlling the electrical current received by the second member.

31. The device of claim 29, wherein the first, second and third apertures are aligned.

32. The device of claim 29, wherein the second elongated grid is electrically connected to a ground source.

33. The device of claim 29, wherein the first, second and third elongated grids each comprise elongated conductive strips mounted on the at least one elongated support extending perpendicularly from the substrate.

34. The device of claim 29, wherein the first member is affixed to the substrate at opposite ends of the first member, and wherein a substantial portion of the first member is suspended over the cavity of the substrate, thereby forming a gap between the first member and substrate.

35. The device of claim 29, wherein the first, second and third elongated grids comprise at least one of tungsten, gold, nickel, molybdenum, platinum, titanium and tantalum.

36. The device of claim 29, wherein the controlled environment is an enclosed area surrounding the first, second and third elongated grids, the cathode, and the anode, wherein the enclosed area has a vacuum drawn therein.

37. The device of claim 29, wherein the controlled environment is an enclosed area filled with a gas selected from the group consisting of hydrogen, helium, argon, and mercury.

38. A thermionic emission device, comprising:

a substrate means having a cavity that extends into the substrate;

a cathode means having an electron-emitting coating disposed thereon, wherein the cathode means is suspended near the opening of the cavity in the substrate means;

an anode means constructed of an electrically conductive material, wherein the anode means is configured to receive electrons emitted by the cathode means;

a grid means supported on at least one elongated wall-shaped support extending perpendicularly from the substrate means, the wall-shaped support configured to be free standing and not supporting the anode means, the grid means forming at least one aperture configured for allowing passage of electrons therethrough, and wherein the grid means is positioned between the anode means and the cathode means, but not directly in a path for electrons to travel from the cathode means to the anode;

a seal for creating a controlled environment in an area surrounding the anode means, the cathode means, and the grid means; and a circuit configured for heating the cathode means.

39. The device of claim 38, further comprising, at least one control circuit for selectively supplying a voltage to the grid means to control the magnitude of flow of electrons through the at least one aperture of the grid means, thereby controlling the electrical current received by the anode means.

* * * * *